US008172350B2

(12) United States Patent
Okuda et al.

(10) Patent No.: US 8,172,350 B2
(45) Date of Patent: May 8, 2012

(54) IMAGE FORMING APPARATUS

(75) Inventors: Takayuki Okuda, Yamagata-mura (JP); Masaki Shimomura, Matsumoto (JP); Kazuhisa Kawakami, Matsumoto (JP); Hidetake Nishizawa, Shiojiri (JP); Nobumasa Fukushima, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 511 days.

(21) Appl. No.: 12/422,024

(22) Filed: Apr. 10, 2009

(65) Prior Publication Data

US 2009/0262160 A1 Oct. 22, 2009

(30) Foreign Application Priority Data

Apr. 10, 2008 (JP) ..... 2008-102420

(51) Int. Cl.

| | |
|---|---|
| ***B41J 25/308*** | (2006.01) |
| ***B41J 29/38*** | (2006.01) |
| ***B41J 23/00*** | (2006.01) |
| ***B41J 2/175*** | (2006.01) |

(52) U.S. Cl. ..... 347/8; 347/9; 347/37; 347/85

(58) Field of Classification Search ..... 347/8, 9, 347/37, 85

See application file for complete search history.

(56) References Cited

U.S. PATENT DOCUMENTS

| | | | | |
|---|---|---|---|---|
| 7,585,123 | B2 * | 9/2009 | Ueda et al. | 347/8 |
| 7,722,182 | B2 * | 5/2010 | Sasa | 347/8 |
| 7,857,418 | B2 * | 12/2010 | Matsuhashi et al. | 347/32 |

FOREIGN PATENT DOCUMENTS

| | | |
|---|---|---|
| JP | 2004-322515 | 11/2004 |

* cited by examiner

*Primary Examiner* — Matthew Luu
*Assistant Examiner* — Jannelle M Lebron
(74) *Attorney, Agent, or Firm* — Workman Nydegger

(57) ABSTRACT

An image forming apparatus includes a moving mechanism having a first member supported by a recording section so as to be movable along a first axis, and capable of moving the recording section in one direction and its opposite direction along a second axis intersecting the first axis according to the movement of the first member in one direction along the first axis relative to the recording section, thereby adjusting a gap between the recording section and a target; a first drive mechanism which moves the recording section supporting the first member along the first axis; and an abutting member which is arranged in a position capable of abutting on the first member by the movement of the recording section, and moves the first member in one direction relative to the recording section by the abutment on the first member.

16 Claims, 16 Drawing Sheets

IMAGE FORMING APPARATUS

BACKGROUND

1. Technical Field

The present invention relates to an image forming apparatus.

2. Related Art

As an image forming apparatus which forms an image on a recording medium, an ink jet printer which ejects ink onto a sheet-like recording medium from a recording head, and forms an image on the recording medium is known. The ink jet printer includes a gap adjusting device which adjusts a gap between the recording head and the recording medium, for example, as disclosed in JP-A-2004-322515.

When the adjusting operation of the gap requires substantial time or is complicated, the processing efficiency of the image forming apparatus may be lowered. Therefore, contrivance of a technique which can execute gap adjustment efficiently is desired.

SUMMARY

An advantage of some aspects of the invention is that it provides an image forming apparatus which can execute gap adjustment efficiently, and can control a decrease in processing efficiency.

According to a first aspect of the invention, an image forming apparatus includes a moving mechanism having a first member supported by a recording section so as to be movable along a first axis, and capable of moving the recording section in one direction and its opposite direction along a second axis intersecting the first axis according to the movement of the first member in one direction along the first axis relative to the recording section, thereby adjusting a gap between the recording section and a target; a first drive mechanism which moves the recording section supporting the first member along the first axis; and an abutting member which is arranged in a position capable of abutting on the first member by the movement of the recording section outside a recording region where recording operation of the recording section is executed, and moves the first member in one direction relative to the recording section by the abutment on the first member.

According to the first aspect of the invention, only by moving the first object in one direction along the first axis with respect to the recording section in a state where the abutting member and at least a portion of the first member are made to abut on each other, the recording section can be moved in one direction and its opposite direction along the second axis, and adjustment of a gap between the recording section and the target can be executed efficiently. Accordingly, a decrease in processing efficiency can be controlled.

In the first aspect of the invention, the position of the abutting member is fixed, the first drive mechanism moves the recording section supporting the first member in one direction toward the abutting member in a state where the abutting member and at least a portion of the first member are made to abut on each other, and the first member moves in one direction relative to the recording section by the driving of the first drive mechanism. Thereby, adjustment of the gap between the recording section and the target can be executed well only by moving the recording section in one direction.

In the first aspect of the invention, the movement distance of the recording section along the second axis is adjusted according to the relative movement distance. Thereby, only by adjusting the relative movement distance of the first member, the movement distance of the recording section along the second axis can be adjusted, and the gap between the recording section and the target can be adjusted efficiently.

In the first aspect of the invention, the movement direction of the recording section along the second axis is adjusted according to the relative movement distance. Thereby, only by adjusting the relative movement distance of the first member, the movement direction of the recording section along the second axis can be adjusted, and the gap between the recording section and the target can be adjusted efficiently.

In the first aspect of the invention, the first member changes in thickness along the first axis, and relatively moves between a predetermined face of the recording section, and a reference surface of a reference member. Thereby, the first object can be moved according to the thickness of the first member arranged between the predetermined face and the reference surface.

In the first aspect of the invention, the image forming apparatus further includes a second member which is supported by the recording section so as to be relatively movable along the second axis, and supports the first member between the second member and the recording section so as to be movable along the first axis. The reference member includes the second member. Thereby, the recording section can be moved according to the thickness of the first member arranged between the recording section and the second member.

In the first and aspect of the invention, the image forming apparatus further includes a supporting member which supports the reference member so that the position of the reference member along the second axis is substantially fixed. Thereby, the recording section can be moved with respect to the reference member supported by the supporting member.

In the first aspect of the invention, the image forming apparatus further includes a first biasing member which biases the recording section and the reference member so that the recording section and the reference member approach each other. Thereby, by the biasing force of the first biasing member, the first member can be pinched between the recording section and the reference member, and the recording section can be moved well according to the thickness of the first member arranged between the predetermined face and the reference surface.

In the first aspect of the invention, the image forming apparatus further includes a cap member which covers at least a portion of the recording section outside the recording region where the abutting member is arranged. Thereby, gap adjusting operation and capping operation can be executed in the same region.

In the first aspect of the invention, the image forming apparatus further includes a second drive mechanism which moves the cap member with the movement of the recording section toward the abutting member so as to approach the recording section. Thereby, gap adjusting operation and capping operation can be executed in parallel.

In the first aspect of the invention, the second drive mechanism includes a contact portion which is connected to the cap member, contacts at least a portion of the recording section which moves toward the abutting member, and is movable in synchronization with the movement of the recording section, and a guide member which guides the cap member so as to approach the recording section. Thereby, the recording section and the cap member can be made to approach each other efficiently with the movement of the recording section.

In the first aspect of the invention, the moving mechanism moves the recording section so as to approach the cap member with the movement of the recording section toward the abutting member in a state where the first member and the abutting member contact each other. Thereby, the recording section and the cap member can be made to approach each other efficiently with the movement of the recording section.

In the first aspect of the invention, the image forming apparatus further includes a specifying portion which specifies the movable range of the first member along the first axis with respect to the recording section, and the recording section comes closest to the cap member when the first member is arranged at one end of the movable range by the movement in one direction. Thereby, for example, when the recording section is moved to the most end of the movable range, the recording section and the cap member can be favorably made to approach each other.

In the first aspect of the invention, the image forming apparatus further includes a reset mechanism which returns the first member arranged at one end of the movable range to the other end (initial position along the first axis) thereof by the movement in one direction. Thereby, only by moving the first member to a predetermined position in one direction, the first member can be returned to the other end (initial position along the first axis), and the recording section can be returned to the initial position along the second axis. Even in a situation where a certain error occurs and a trouble occur in control of a recording position, the errors can be eliminated with easy operation.

In the first aspect of the invention, the image forming apparatus further includes a stopper mechanism which regulates the movement of the first member with respect to the recording section in a given position along the first axis. Thereby, the position of the recoding section can be fixed in a position along the second axis according to the given position of the first member the movement of which is regulated.

In the first aspect of the invention, the recording section includes at least one of an ejection head capable of ejecting a fluid, and a carriage which supports the ejection head. Thereby, the gap between the ejection head and the target can be adjusted efficiently.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the drawings. In the following description, an XYZ orthogonal coordinate system is set, and the positional relationship of respective members is described with reference to this XYZ orthogonal coordinate system. A predetermined direction within a horizontal plane is defined as an X-axis direction, a direction orthogonal to the X-axis direction in the horizontal plane is defined as a Y-axis direction, and a direction orthogonal to both the X-axis direction and the Y-axis direction (that is, a perpendicular direction) is defined as a Z-axis direction.

First Embodiment

Figure 1:
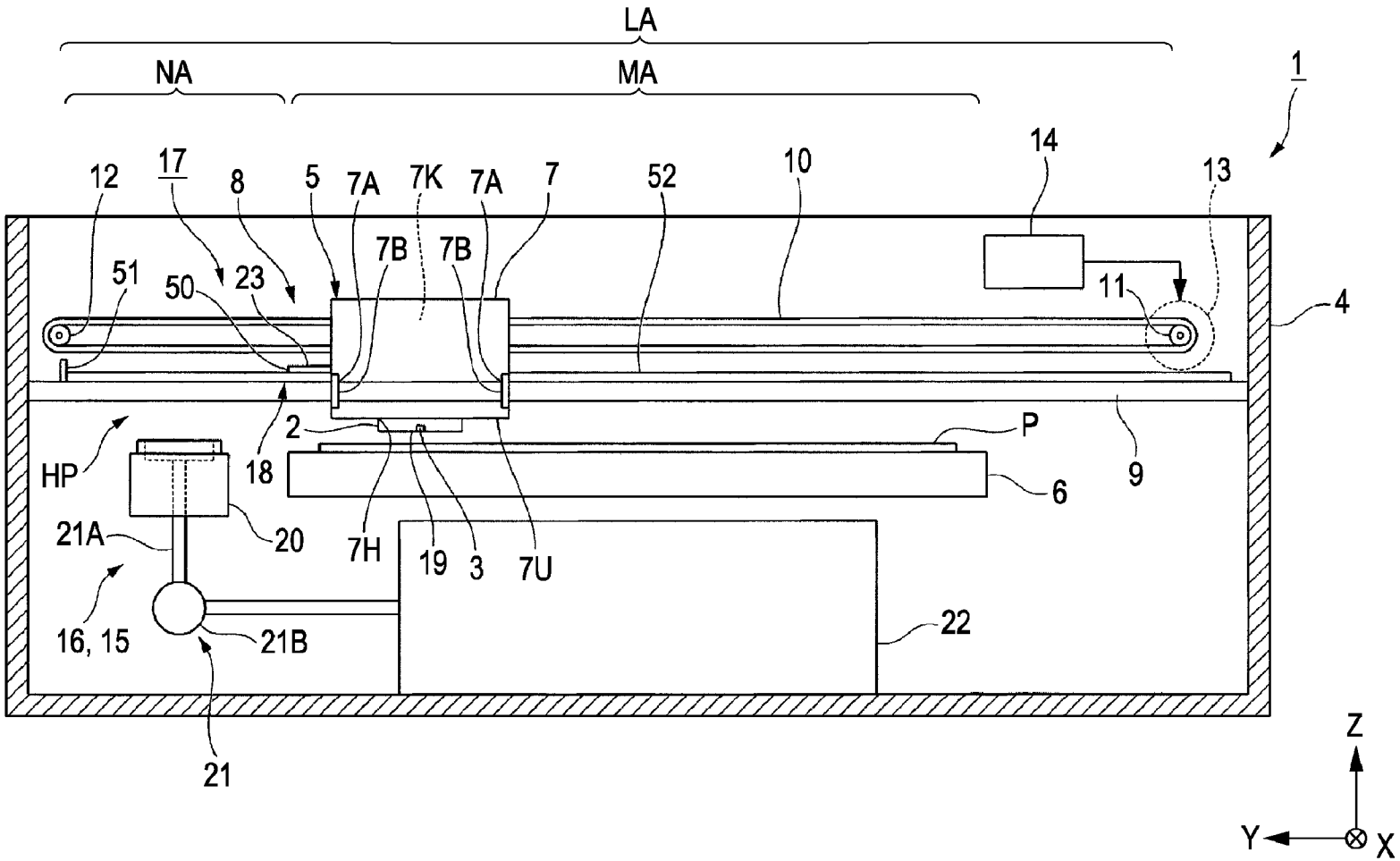
FIG. 1 is a schematic diagram showing an example of an image forming apparatus including a gap adjusting device according to a first embodiment.

A first embodiment will be described. FIG. 1 is a schematic diagram showing an example of an image forming apparatus 1 according to a first embodiment. In this embodiment, a case where the image forming apparatus 1 is a liquid ejecting apparatus (liquid substance ejecting apparatus) which ejects a liquid (liquid substance), such as ink, and records an image on a sheet-like recording medium P will be described as an example. In this embodiment, a case where a fluid ejecting apparatus 1 is an ink jet image forming apparatus which ejects ink onto a recording medium P from an ejection port 3 of a recording head 2, and forms an image on the recording medium P will be described as an example. In this embodiment, an ink jet printer which discharges (ejects) droplets of ink onto a recording paper P which is the sheet-like recording medium, and forms an image on the recording paper P will be described as an example of the ink jet image forming apparatus 1.

In FIG. 1, the ink jet printer 1 includes a housing 4, a recording section 5 which is arranged within the housing 4 and is able to form an image on the recording paper P in ink, a platen 6 which supports the recording paper P, and a control device 14 which controls the operation of the whole ink jet printer 1. The recording section 5 includes the recording head 2 which is able to eject ink, and a movable carriage 7 which supports the recording head 2.

Additionally, the ink jet printer 1 includes a first drive mechanism 8 which moves the recording section 5 along the Y axis. The first drive mechanism 8 includes a guide member 9 which guides movement of the recording section 5, a timing belt 10 which supports the carriage 7, a driving pulley 11 arranged at one end (−Y-side end) of the timing belt 10, a driven pulley 12 arranged at the other end (+Y-side end), and a motor 13 which drives the driving pulley 11.

Additionally, the ink jet printer 1 includes a maintenance device 15 which is able to maintain the recording head 2. The maintenance device 15 includes a capping unit 16 and a wiping unit (not shown). The maintenance device 15 is arranged at a home position HP of the recording section 5. The home position HP is provided in an end region NA outside a recording region MA where recording operation by the recording section 5 is executed, within a movement region LA of the recording section 5.

The platen 6 is arranged in the recording region MA to support the recording paper P to be supplied with the ink from the recording head 2. In order to supply ink to the recording paper P supported by the platen 6, the control device 14 arranges the recording section 5 in the recording region MA by using the first drive mechanism 8.

Additionally, in this embodiment, the ink jet printer 1 includes a gap adjusting device 17 which adjusts a gap between the recording section 5 and the recording paper P supported by the platen 6. In this embodiment, the gap adjusting device 17 includes a moving mechanism 18 which moves the recording section 5 along the Z axis. The gap adjusting device 17 moves the recording section 5 in one direction (+Z direction) and its opposite direction (−Z direction) along the Z axis by using the moving mechanism 18, and adjusts the gap between the recording section 5 and the recording paper P supported by the platen 6.

The recording head 2 is a so-called electromechanical conversion type droplet discharge head. The recording head 2 has a piezoelectric element and a space the pressure of which changes by the deformation of the piezoelectric element. The space is formed by a flexible film displaced by the deformation of the piezoelectric element, a plate (nozzle plate) having an ejection port 3, etc. Ink is reserved in the space. When a pulsate electric signal is supplied to the piezoelectric element, the piezoelectric element is deformed on the basis of the electric signal. When the flexible film is displaced by the deformation of the piezoelectric element, the pressure of the space in which ink is reserved changes. Some of the ink in the space is ejected (discharged) from the ejection port 3 by the change of the pressure.

The recording head 2 includes an ejection face 19 in which the ejection port 3 which ejects ink is formed. The ejection port 3 is able to discharge droplets of ink. In this embodiment, the ejection face 19 is nearly parallel to an XY plane. A plurality of the ejection ports 3 is formed at predetermined intervals, for example, along the Y axis in the ejection face 19.

The carriage 7 is movable while supporting the recording head 2. The carriage 7 is a box member and has an inner space 7K in which the recording head 2 can be housed. The carriage 7 has an opening 7H in a bottom face (−Z-side face) 7U which faces the platen 6. A portion of the recording head 2 including the ejection face 19 is arranged in the opening 7H.

The platen 6 is arranged in the position which faces the ejection face 19 of the recording head 2 supported by the carriage 7, and supports one face of the recording paper P. The recording section 5 including the recording head 2 and the carriage 7 is arranged above (+Z side) the platen 6.

The first drive mechanism 8 moves the recording section 5 along the Y axis. The recording section 5 is movable inside a predetermined movement region LA, which is long in the Y-axis direction, including the recording region MA and the end region NA, by the driving of the first drive mechanism 8.

The guide member 9 guides movement of the carriage 7. The guide member 9 is a rod member which is long in the Y-axis direction. Both ends of the guide member 9 are supported by the housing 4. The carriage 7 has a guided portion 7B having a hole 7A in which the guide member 9 is arranged. Two guided portions 7B are arranged along the Y axis on the side faces of the carriage 7 which face the −X direction. The driving pulley 11 is arranged in the vicinity of one end (−Y-side end) of the guide member 9. The driven pulley 12 is arranged in the vicinity of the other end (+Y-side end) of the guide member 9. The driving pulley 11 is rotated by the driving of the motor 13. A timing belt 10 is stretched over the driving pulley 11 and the driven pulley 12. A portion of the timing belt 10 is fixed to the carriage 7.

When the driving pulley 11 is rotated by the driving of the motor 13, the timing belt 10 stretched on the driving pulley 11 and the driven pulley 12 rotates. As the timing belt 10 rotates, the carriage 7 fixed to (supported by) the timing belt 10 moves along the Y axis while being guided by the guide member 9. The control device 14 adjusts the rotational direction of the driving pulley 11 on the basis of the driving of the motor 13, so that the carriage 7 is movable in the +Y direction and the −Y direction. As such, the recording section 5 including the carriage 7 and the recording head 2 supported by the carriage 7 is movable along the Y axis, and is movable in one direction (+Y direction) and its opposite direction (−Y direction) along the Y axis.

The recording paper P is movable along the X axis by a recording paper transport mechanism (not shown) between the recording section 5 and the platen 6. The control device 14 discharges ink onto the recording paper P supported by the platen 6 from the recording head 2 of the recording section 5 while executing the movement of the recording section 5 in the Y-axis direction by the first drive mechanism 8, and the movement of the recording paper P in the X-axis direction by the recording paper transport mechanism. This causes an image to be formed on the recording paper P.

The capping unit 16 includes a cap member 20 which is able to face the ejection face 19 of the recording head 2. The cap member 20 is able to cover the ejection face 19. The cap member 20 covers the ejection face 19 in the end region NA outside the recording region MA. The cap member 20 is arranged below the recording section 5 including the recording head 2 and the carriage 7 (−Z side).

The cap member 20 is able to form a space between the cap member and the ejection face 19. Additionally, the capping unit 16 includes a suction unit 21 which is able to suck the ink in the space formed between the cap member 20 and the ejection face 19. The suction unit 21 includes a suction tube 21A connected to the bottom of the cap member 20, and a suction pump 21B arranged in the suction tube 21A. The ink sucked by the suction unit 21 is recovered by a recovery tank 22.

Figure 2:
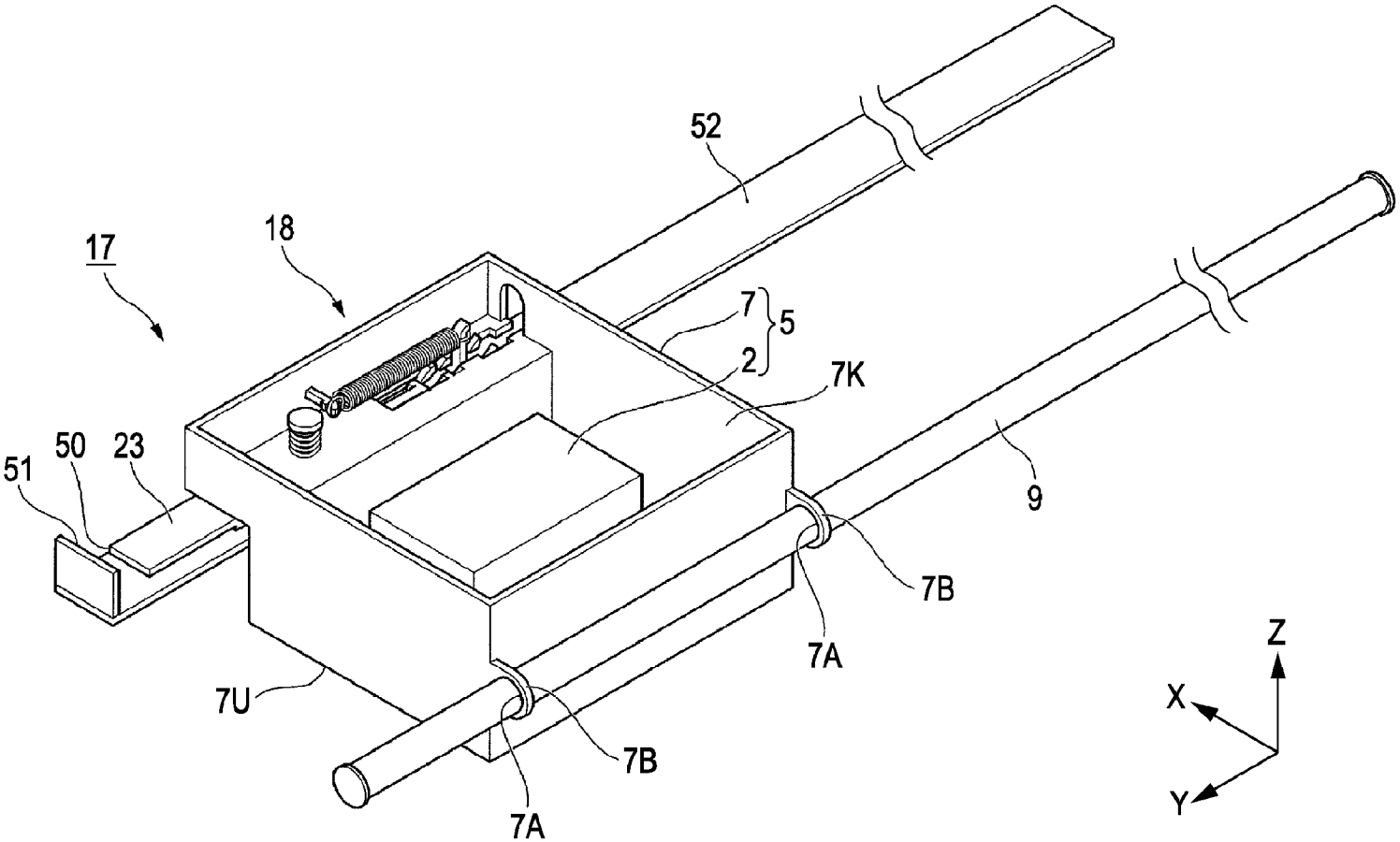
FIG. 2 is a perspective view showing a portion of the gap adjusting device according to the first embodiment.
Figure 3:
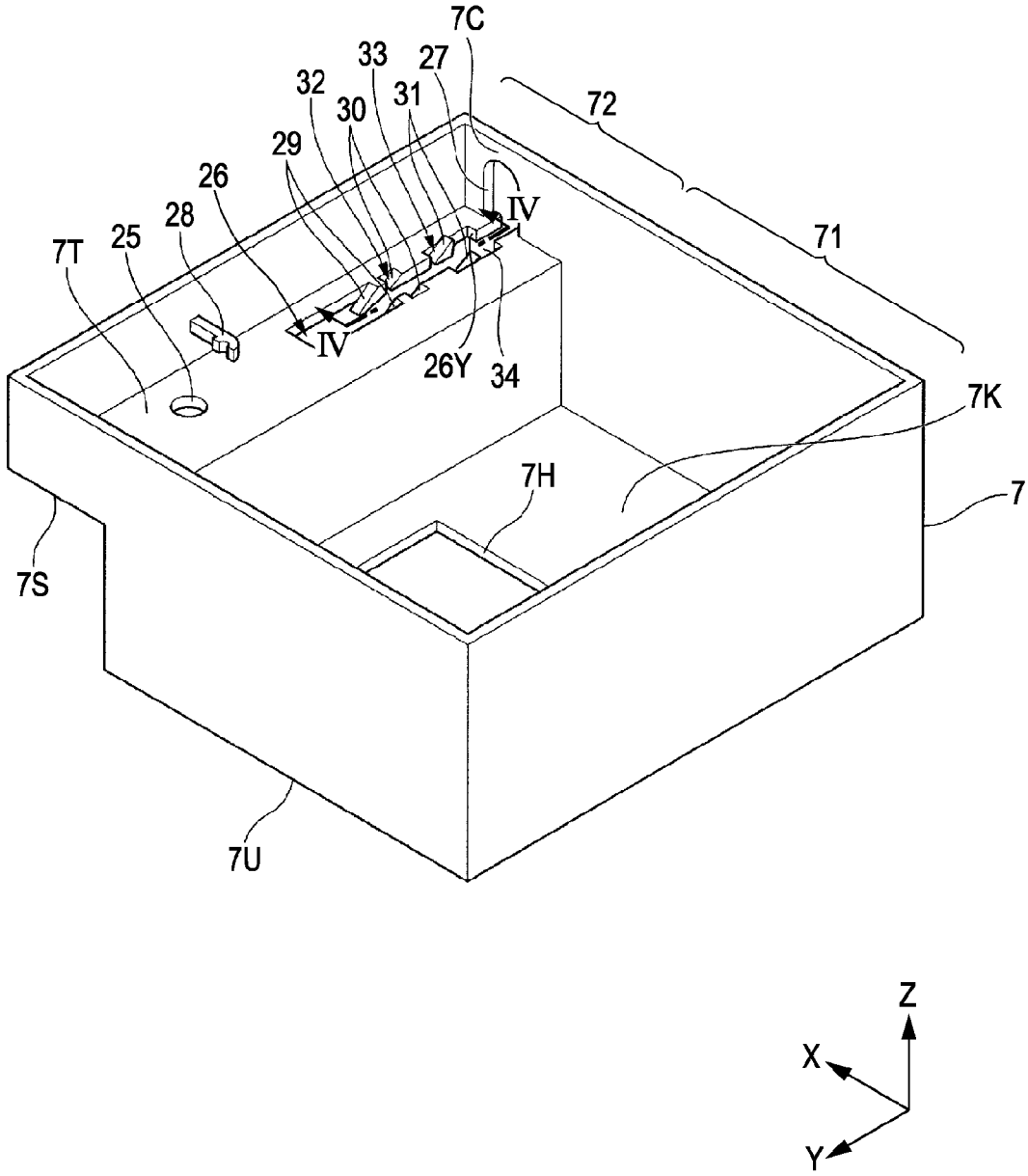
FIG. 3 is a perspective view showing a carriage moved by the gap adjusting device according to the first embodiment.
Figure 4:
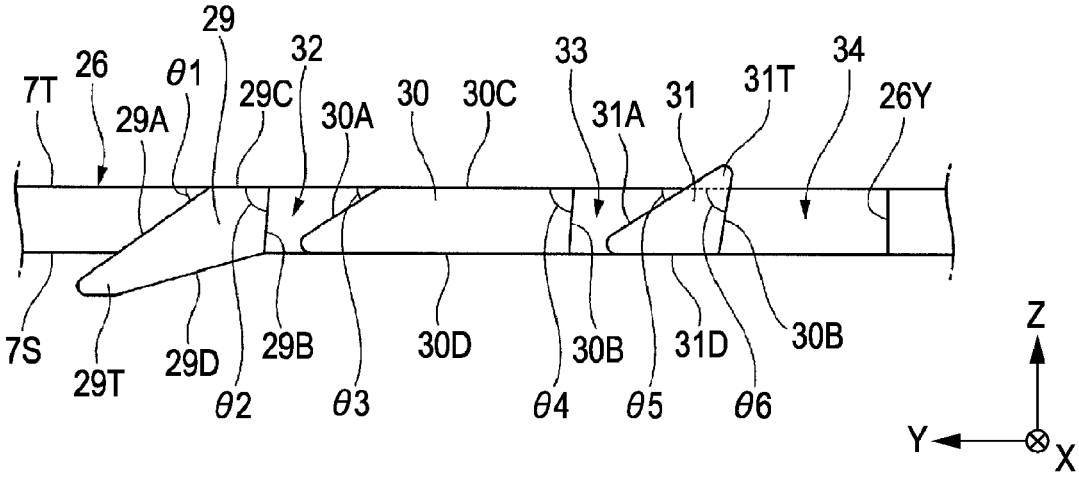
FIG. 4 is a sectional view taken along a line IV-IV of FIG. 3.
Figure 5:
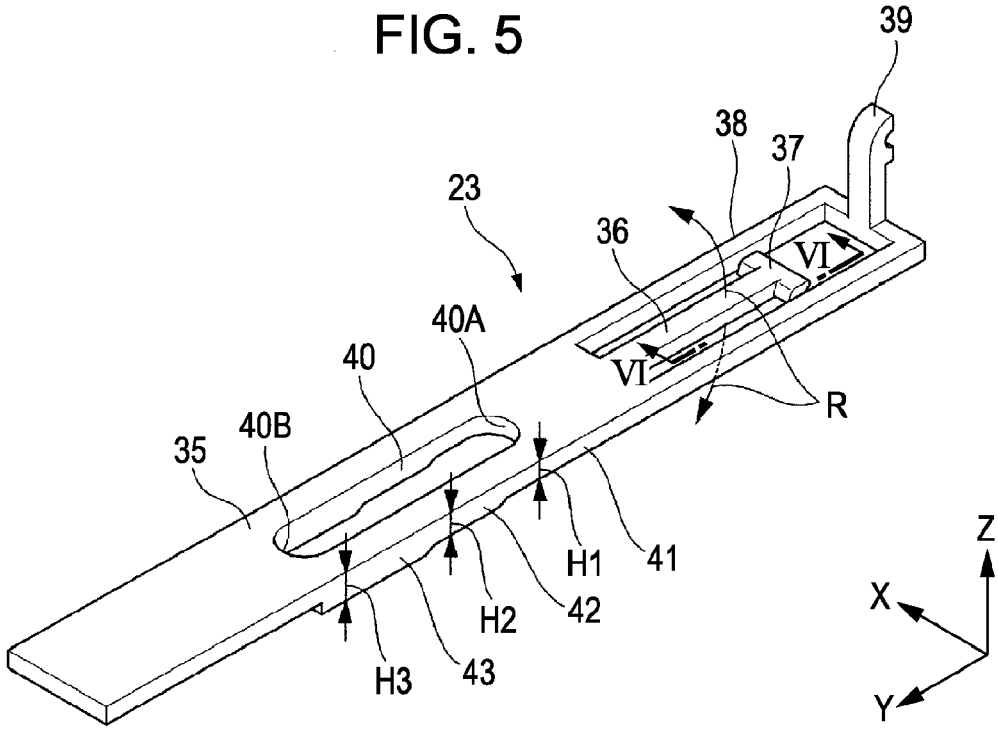
FIG. 5 is a perspective view showing a first member of the gap adjusting device according to the first embodiment.
Figure 6:
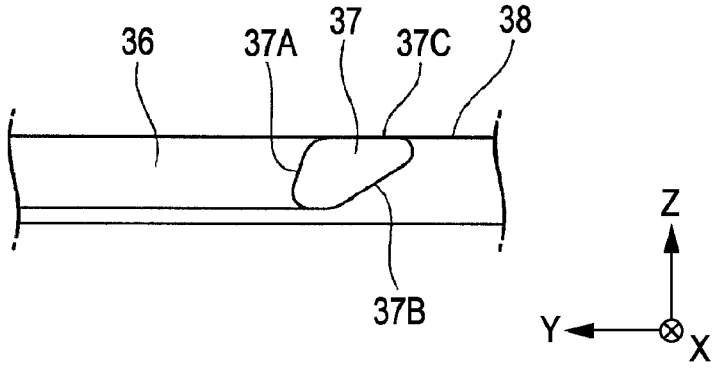
FIG. 6 is a sectional view taken along a line VI-VI of FIG. 5.
Figure 7A:
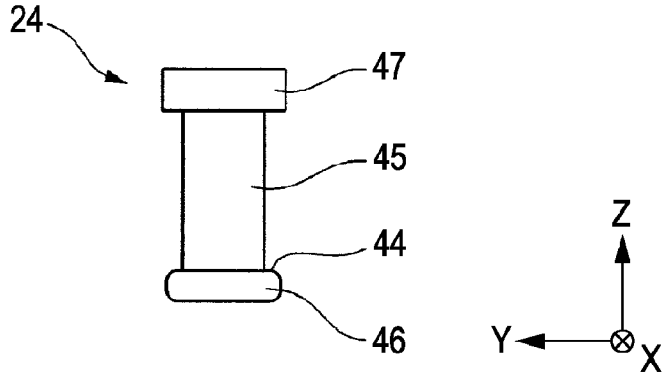
FIGS. 7A and 7B are views showing a second member of the gap adjusting device according to the first embodiment.
Figure 7B:
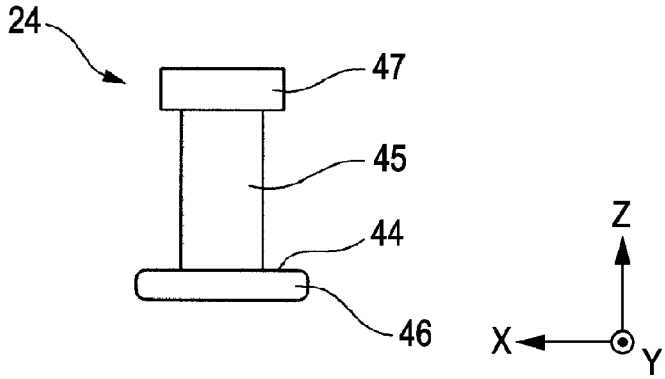
Figure 8:
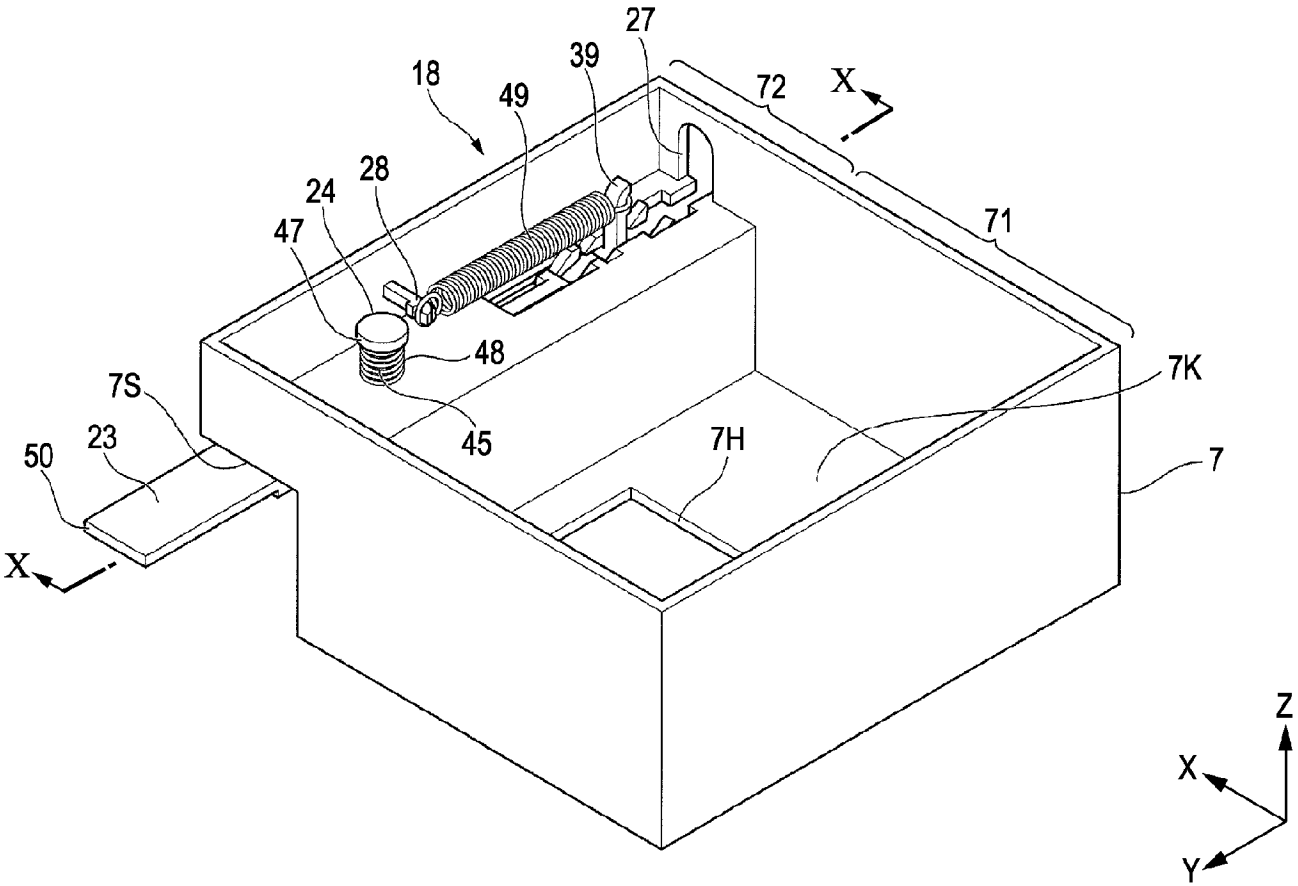
FIG. 8 is a perspective view showing a moving mechanism of the gap adjusting device according to the first embodiment.
Figure 9:
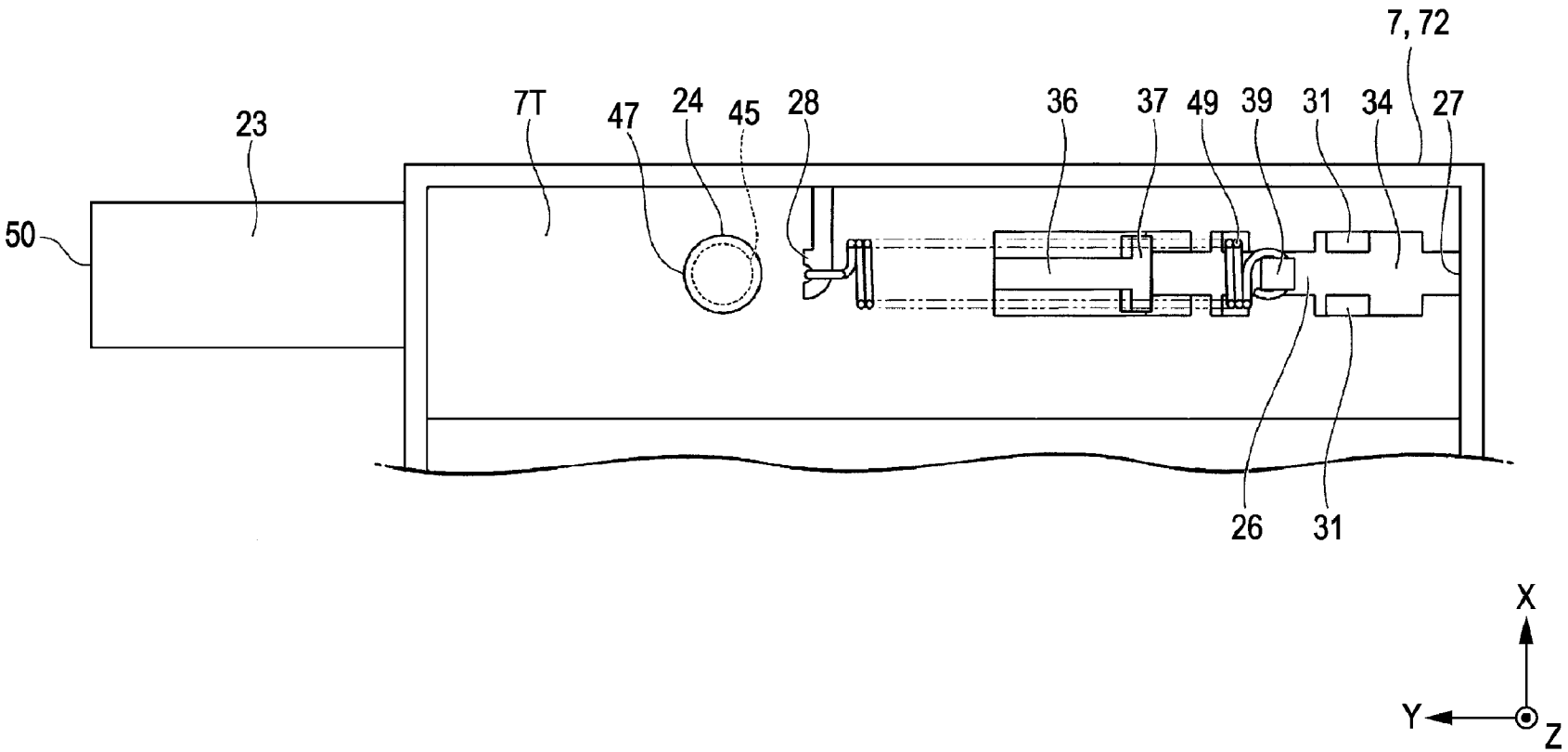
FIG. 9 is a plan view when the moving mechanism according to the first embodiment is seen from above.
Figure 10:
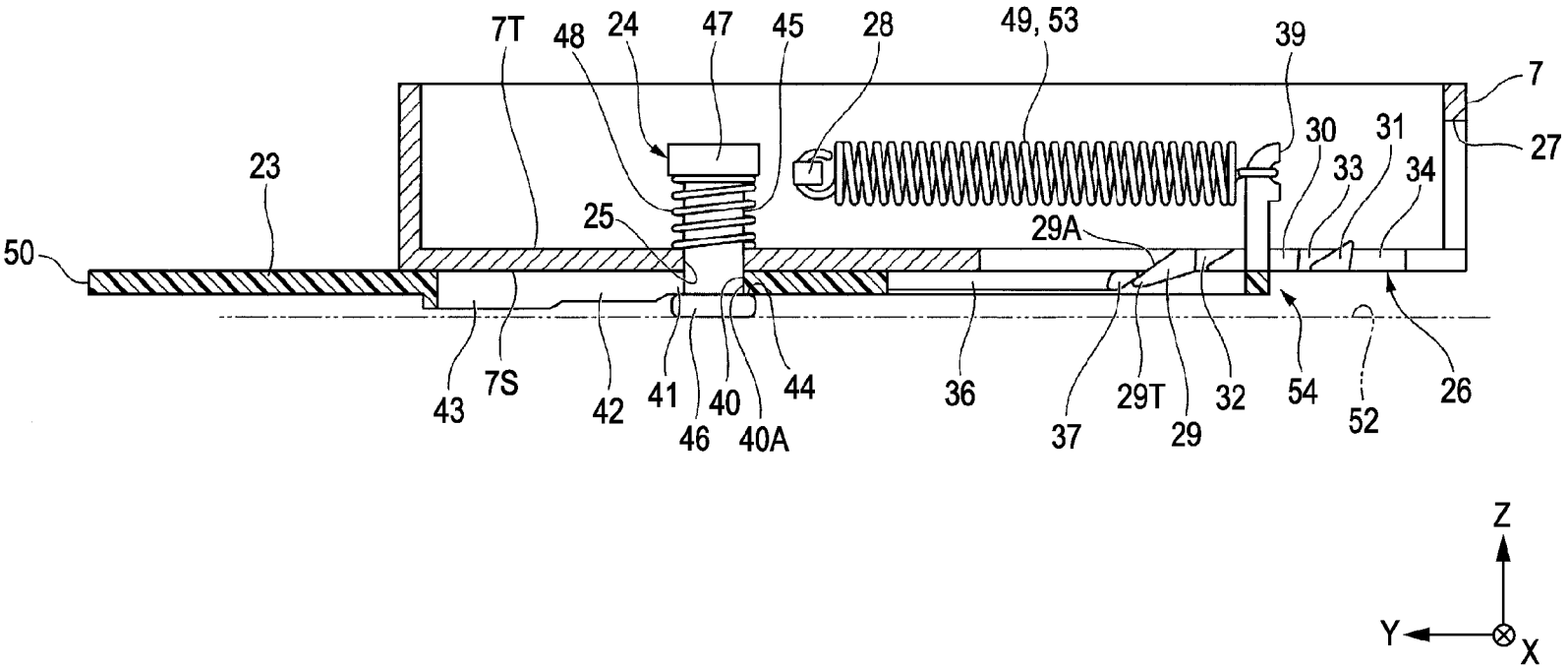
FIG. 10 is a sectional view taken along a line X-X of FIG. 8.

Next, the gap adjusting device 17 will be described with reference to FIGS. 2 to 10. FIG. 2 is a perspective view showing a portion of the gap adjusting device 17, FIG. 3 is a perspective view showing the carriage 7 moved by the gap adjusting device 17, FIG. 4 is a sectional view taken along a line IV-IV of FIG. 3, FIG. 5 is a perspective view showing a first member 23 of the gap adjusting device 17, FIG. 6 is a sectional view taken along a line VI-VI of FIG. 5, FIGS. 7A and 7B are views showing a second member 24 of the gap adjusting device 17, FIG. 8 is a perspective view showing the moving mechanism 18 of the gap adjusting device 17, FIG. 9 is a plan view when the moving mechanism 18 is seen from above, and FIG. 10 is a sectional view taken along a line X-X of FIG. 8. In addition, in FIG. 3, FIG. 8, etc., illustration of the recording head 2 and the guided portion 7B of the carriage 7 is omitted.

The gap adjusting device 17 includes the moving mechanism 18 having the first member 23 supported by the carriage 7 so as to be movable along the Y axis, and capable of moving the carriage 7 in one direction (+Z direction) and its opposite direction (−Z direction) along the Z axis which intersects the Y axis according to movement of the first member 23 in one direction (−Y direction) along the Y axis relative to the carriage 7, thereby adjusting the gap between the recording head 2 supported by the carriage 7 and the recording paper P supported by the platen 6.

As shown in FIG. 3, the carriage 7 has a first portion 71 including the inner space 7K in which the recording head 2 is arranged, and a second portion 72 in which the moving mechanism 18 is provided. The first portion 71 includes the bottom face 7U and the opening 7H. The second portion 72 is arranged on the +X side of the first portion 71. The second portion 72 has a bottom face 7S arranged nearer to the +Z side than the bottom face 7U, and a top face 7T opposite the bottom face 7S. The bottom face 7S is a face which faces the −Z side, and is nearly parallel to the XY plane. The top face 7T is a face which faces the Z side, and is nearly parallel to the XY plane.

The second portion 72 has a hole 25 which is formed so that the top face 7T and the bottom face 7S communicate with each other, and an opening 26 which is arranged on the −Y side of the hole 25, and is formed so that the top face 7T and the bottom face 7S communicate with each other. The hole 25 is substantially circular within the XY plane. The opening 26 is long in the Y-axis direction within the XY plane. Additionally, a side plate 7C of the second portion 72 on the −Y side of the opening 26 is formed with a first passage 27 which passes through the side plate 7C. The first passage 27 is formed so as to be connected with the opening 26. Additionally, a first hook portion 28 is arranged in a given position on the +Y side of the opening 26. The first hook portion 28 is fixed to the carriage 7. The first hook portion 28, the opening 26, and the first passage 27 are arranged along the Y axis.

First, second, and third cam members 29, 30, and 31 are arranged on the inner face of the opening 26. The first cam members 29 are respectively arranged on the +X side and −X side with respect to the center of the opening 26 in the X-axis direction. Similarly, the second cam members 30 are respectively arranged on the +X side and −X side with respect to the center of the opening 26 in the X-axis direction, and the third cam members 31 are respectively arranged on the +X side and −X side with respect to the center of the opening 26 in the X-axis direction. Among the first, second, and third cam members 29, 30, and 31, the first cam members 29 are arranged nearest to the +Y side, the second cam members 30 are arranged on the +Y side next to the first cam member 29, and the third cam members 31 are arranged nearest to the −Y side.

As shown in FIG. 4, each first cam member 29 has a first face 29A which faces the +Y side and inclines toward the −Y side with respect to the Z axis, a second face 29B which faces −Y side, a third face 29C which connects an upper end of the first face 29A and an upper end of the second face 29B, and is nearly parallel to the XY plane, and a fourth face 29D which connects a lower end of the first face 29A and a lower end of the second face 29B. The third face 29C is arranged in almost the same plane as (flush with) the top face 7T. In this embodiment, the angle θ1 formed by the top face 7T and the first face 29A is smaller than 90 degrees (an acute angle). In this embodiment, the angle θ1 is, for example, 30 degrees. Additionally, the angle θ2 formed by the top face 7T (the third face 29C) and the second face 29B is smaller than 90 degrees. In this embodiment, the angle θ2 is, for example, 85 degrees. Additionally, the first cam member 29 includes a protruding portion 29T, which protrudes toward −Z side from the bottom face 7S, between the first face 29A and the fourth face 29D.

Each second cam member 30 has a fifth face 30A which faces the +Y side and inclines toward the −Y side with respect to the Z axis, a sixth face 30B which faces −Y side, a seventh face 30C which connects an upper end of the fifth face 30A and an upper end of the sixth face 30B, and is nearly parallel to the XY plane, and an eighth face 30D which connects a lower end of the fifth face 30A and a lower end of the sixth face 30B. The seventh face 30C is arranged in almost the same plane as (flush with) the top face 7T. The eighth face 30D is arranged in almost the same plane as (flush with) the bottom face 7S. In this embodiment, the angle θ3 formed by the top face 7T and the fifth face 30A is smaller than 90 degrees (an acute angle). In this embodiment, the angle θ3 is, for example, 30 degrees. Additionally, the angle θ4 formed by the top face 7T (the seventh face 30C) and the sixth face 30B is smaller than 90 degrees. In this embodiment, the angle θ4 is, for example, 85 degrees.

Each third cam member 31 has a ninth face 31A which faces the +Y side and inclines toward the −Y side with respect to the Z axis, a tenth face 31B which faces −Y side, and an eleventh face 31D which connects a lower end of the ninth face 31A and a lower end of the tenth face 31B, and is nearly parallel to the XY plane. The eleventh face 31D is arranged in almost the same plane as (flush with) the bottom face 7S. In this embodiment, the angle θ5 formed by the top face 7T and the ninth face 31A is smaller than 90 degrees (an acute angle). In this embodiment, the angle θ5 is, for example, 30 degrees. Additionally, the angle θ6 formed by the top face 7T and the tenth face 31B is smaller than 90 degrees. In this embodiment, the angle θ6 is, for example, 85 degrees. Additionally, the third cam member 31 includes a protruding portion 31T, which protrudes toward +Z side from the top face 7T, between the ninth face 31A and the tenth face 31B.

In this embodiment, a first recess 32 is provided between the first cam member 29 and the second cam member 30, and a second recess 33 is provided between the second cam member 30 and the third cam member 31. The first recess 32 and the second recess 33 are arranged at the carriage 7 (the second portion 72) along the Y axis. The first recess 32 is arranged on the +Y side of the second recess 33.

Additionally, in this embodiment, the angle θ1, the angle θ3, and the angle θ5 are almost the same, and the angle θ2, the angle θ4, and the angle θ6 are almost the same.

In this embodiment, with respect to the Y-axis direction, the distance between the second face 29B and the fifth face 30A and the distance between the sixth face 30B and the ninth face 31A are almost the same. Additionally, the angle θ2 and the angle θ4 are almost the same, and the angle θ3 and the angle θ5 are almost the same. Accordingly, in this embodiment, the first recess 32 and the second recess 33 have almost the same shape.

Additionally, in this embodiment, with respect to the Y-axis direction, the distance between the tenth face 31B and an inner face 26Y of the opening 26 which faces the tenth face 31B is sufficiently larger than the distance between the second face 29B and the fifth face 30A, and the distance between the sixth face 30B and the ninth face 31A. In the following description, a portion of the opening 26 between the tenth face 31B, and the inner face 26Y which faces the tenth face 31B, is appropriately referred to as a second passage 34.

As shown in FIG. 5, the first member 23 is a member which is long in the Y-axis direction. The first member 23 includes a main body 35, an arm portion 36 which is arranged on the −Y side of the main body 35 and is long in the Y-axis direction, a projection 37 which is arranged at the tip of the arm portion 36, a frame portion 38 which is arranged on the −Y side of the main body 35 so as to surround the arm portion 36 and the projection 37, and a second hook portion 39 which is arranged at the −Y-side end of the top face (face which faces the +Z side) of the frame portion 38.

The arm portion 36 supports the projection 37. With respect to the X-axis direction, the projection 37 is larger than the arm portion 36. A base end of the arm portion 36 opposite the tip where the projection 37 is arranged is connected to the main body 35. In this embodiment, the first member 23 is made of, for example, synthetic resin. The arm portion 36 is elastically deformable in the direction (substantially in the Z-axis direction) of an arrow R in FIG. 5. The projection 37 arranged at the tip of the arm portion 36 whose base end is supported by the main body 35 is movable substantially in the Z-axis direction by the elastic deformation of the arm portion 36.

The thickness of the main body 35 changes along the Y-axis. The thickness of the main body 35 is the size of the main body 35 in the Z-axis direction. In this embodiment, the main body 35 has a first portion 41 having a first thickness H1, a second portion 42 having a second thickness H2 larger than the first thickness H1, and a third portion 43 having a third thickness H3 larger than the second thickness H2. Among the first, second, and third portions 41, 42, and 43, the first portion 41 is arranged nearest to the −Y side, the second portion 42 is arranged on the −Y side next to the first portion 41, and the third portion 43 is arranged nearest to the +Y side.

As shown in FIGS. 5 and 6, in this embodiment, respective top faces (faces which face the +Z side) of the main body 35, the arm portion 36, the projection 37, and the frame portion 38 are nearly parallel to the XY plane, and are arranged in the same plane (flush with each other). Respective bottom faces (faces which face the −Z side) of the first portion 41, the second portion 42, and the third portion 43 are nearly parallel to the XY plane. The respective bottom faces of the first portion 41, the second portion 42, and the third portion 43 differ in position in the Z-axis direction.

Additionally, the main body 35 has an opening 40 formed so as to allow the top face and bottom face of the main body 35 to communicate with each other. The opening 40 is long in the Y-axis direction within the XY plane. In the following description, an inner face 40A at an −Y-side end of the opening 40 is appropriately referred to as a first abutting face 40A, and an inner face 40B at an +Y-side end of the opening is appropriately referred to as a second abutting face 40B.

As shown in FIG. 6, the projection 37 has a twelfth face 37A which faces the +Y side and inclines toward the −Y side with respect to the Z axis, a thirteenth face 37B which inclines toward the −Y side with respect to the Z axis, and a fourteenth face (top face) 37C which connects an upper end of the twelfth face 37A and an upper end of the thirteenth face 37B, and is nearly parallel to the XY plane. The top faces of the fourteenth face 37C, the arm portion 36, and the frame portion 38 are arranged within the same plane (flush with each other).

FIG. 7A is a view when the second member 24 is seen from the −X side, and FIG. 7B is a view when the second member 24 is seen from the +Y side. As shown in FIGS. 7A and 7B, the second member 24 has a rod portion 45 which is long in the Z-axis direction, a lower flange portion 46 which is arranged at a lower end of the rod portion 45, and an upper flange portion 47 which is arranged at an upper end of the rod portion 45. Each of the lower flange portion 46 and the upper flange portion 47 is larger than the rod portion 45 within the XY plane. Additionally, in this embodiment, the lower flange portion 46 is larger than the upper flange portion 47 within the XY plane. Additionally, the size of the lower flange portion 46 in the X-axis direction is larger than the size thereof in the Y-axis direction. The lower flange portion 46 has a top face (reference surface) 44 which faces the +Z side.

As shown in FIGS. 8, 9, and 10, the first member 23 is arranged so that the top face of the first member 23 and the bottom face 7S of the carriage 7 (the second portion 72) face each other. The rod portion 45 of the second member 24 is arranged at the opening 25 of the carriage 7, and the opening 40 of the first member 23. In this embodiment, the rod portion 45 and the lower flange portion 46 (or upper flange portion 47) can be released from each other. Accordingly, after the rod portion 45 and the lower flange portion 46 (or upper flange portion 47) are released, and the rod portion 45 are arranged at the opening 25 and the opening 40, the rod portion 45 and the lower flange portion 46 (or upper flange portion 47) can be connected to each other.

The second member 24 is supported so as to pinch the first member 23 between the second member and the bottom face 7S of the carriage 7 (the second portion 72) at the reference surface 44 of the lower flange portion 46. The second member 24 supports the first member 23 between the second member and the carriage 7 (the second portion 72) so as to be movable along the Y axis. The first member 23 is movable in the Y-axis direction between the bottom face 7S of the carriage 7, and the reference surfaces 44 of the lower flange portion 46.

The second member 24 is supported by the second portion 72 of the carriage 7 so as to be relatively movable along the Z axis. The opening 25 is slightly larger than the rod portion 45. Additionally, the opening 40 is sufficiently larger than the rod portion 45. Accordingly, the second member 24 is movable relative to the second portion 72 of the carriage 7 and the first member 23 along the Z-axis.

Additionally, in this embodiment, the gap adjusting device 17 includes a first biasing member 48 which biases the carriage 7 and the lower flange portion 46 so that the carriage 7 and the lower flange portion 46 approach each other. In this embodiment, the first biasing member 48 is a coil spring which is arranged between the upper flange portion 47 and the top face 7T of the carriage 7 (the second portion 72). The coil spring 48 is slightly compressed. The coil spring 48 generates a force in a direction in which the upper flange portion 47 and the carriage 7 are separated from each other. Accordingly, a force is generated by the coil spring 48 in a direction in which the lower flange portion 46 and the carriage 7 approach each other.

Additionally, in this embodiment, the gap adjusting device 17 includes a second biasing member 49 which connects the carriage 7 and the first member 23. In this embodiment, the second biasing member 49 is a coil spring which connects the first hook portion 28 provided in the carriage 7, and the second hook portion 39 provided in the first member 23. The second hook portion 39 of the first member 23 is arranged on the −Y side with respect to the first hook portion 28 of the carriage 7.

Additionally, a +Y-side end 50 of the first member 23 (main body 35) is arranged on the +Y side of the carriage 7 in a state where it is arranged between the carriage 7 and the lower flange portion 46 of the second member 24.

As shown in FIGS. 1 and 2, the abutting member 51 is arranged in a position where it is able to abut the end 50 of the first member 23. The abutting member 51 is arranged in the end region NA outside the recording region MA where recording operation by the recording section 5 is executed. The position of the abutting member 51 is fixed.

As described above, in this embodiment, the carriage 7 is movable along the Y-axis by the first drive mechanism 8. The first drive mechanism 8 is movable along the Y-axis in the carriage 7 supporting the first member 23. The control device 14 is able to move the carriage 7 in the +Y direction in the end region NA by using the first drive mechanism 8, thereby making the end 50 of the first member 23 supported by the carriage 7 abut on (contact) the abutting member 51. The abutting member 51 is arranged in a position where it is able to abut on the end 50 of the first member 23 by the movement of the carriage 7 in the +Y direction. Accordingly, the control device 14 is able to move the carriage 7 in the +Y direction by using the first drive mechanism 8, thereby making the end 50 of the first member 23 supported by the carriage 7 abut on the abutting member 51. The first member 23 is movable along the Y axis relative to the carriage 7 between the bottom face 7S of the carriage 7, and the reference surface 44 of the lower flange portion 46. Accordingly, the first member 23 moves in the −Y direction relative to the carriage 7 by the abutment on the abutting member 51. As described above, in this embodiment, the first member 23 is movable in the −Y direction relative to the carriage 7 by the cooperation between the first drive mechanism 8 which moves the carriage 7 supporting the first member 23 along the Y axis, and the abutting member 51 arranged in a position where it is able to abut on the first member 23 by the movement of the carriage 7 in the +Y direction.

In this embodiment, the carriage 7 and the second member 24 moves the abutting member 51 in the +Y direction by using the first drive mechanism 8 in a state where the position of the abutting member 51 is fixed, and the end 50 of the first member 23 and the abutting member 51 are made to abut on each other. Thereby, the carriage 7 and the second member 24 move in the +Y direction so as to approach the abutting member 51 in a state where the position of the first member 23 with respect to the abutting member 51 does not change. Accordingly, the first member 23 moves in the −Y direction relative to the carriage 7 and the second member 24 by the abutment on the abutting member 51. Hereinafter, for the purpose of simplicity, the configuration in which the first member 23 moves in the −Y direction relative to the carriage 7 by moving the carriage 7 in the +Y direction in a state where the abutting member 51 the position of which is fixed and the end 50 of the first member 23 are made to abut on each other may be simply abbreviated and described that the first member 23 moves in the −Y direction with respect to the carriage 7.

Additionally, as shown in FIGS. 1 and 2, the gap adjusting device 17 includes a supporting member 52 which supports the bottom face of the lower flange portion 46. The supporting member 52 is a member which is long in the Y-axis direction. The position of the supporting member 52 is fixed. The supporting member 52 supports the lower flange portion 46 so that the position of the lower flange portion 46 (second member 24) along the Z axis is substantially fixed.

The top face of the supporting member 52 which faces the bottom face of the lower flange portion 46 is nearly parallel to the XY plane. The lower flange portion 46 is movable so as to slide on the supporting member 52. When the carriage 7 moves to the Y-axis direction by the driving of the first drive mechanism 8, the second member 24 also moves in the Y-axis direction together with the carriage 7. The second member 24 is movable along the Y axis on the supporting member 52 while the bottom face of the lower flange portion 46 is supported by the supporting member 52. Accordingly, even in a case where the carriage 7 has moved in the Y-axis direction, the position of the lower flange portion 46 (second member 24) along the Z axis is substantially fixed.

Next, an example of the operation of the ink jet printer 1 including the gap adjusting device 17 having the above-described configuration will be described with reference to FIGS. 10 to 13. Hereinafter, gap adjusting operation will be mainly described.

In this embodiment, as shown in FIG. 10, when the projection 37 is arranged on the +Y side of the first cam member 29, the first portion 41 of the first member 23 is arranged between the carriage 7 and the lower flange portion 46. Additionally, the coil spring 49 slightly stretches in a state shown in FIG. 10. Accordingly, the coil spring 49 biases the first member 23 toward the +Y side with respect to the carriage 7. That is, the force which moves the first member in the +Y direction with respect to the carriage 7 acts on the first member 23 by the coil spring 49.

In the following description, the state of the first member 23, as shown in FIG. 10, where the projection 37 is arranged on the +Y side of the first cam member 29 is appropriately referred to as an initial state. In the initial state, the carriage 7 is arranged in a given position in the Z-axis direction according to the first thickness H1 of the first portion 41.

In the initial state where the projection 37 is arranged on the +Y side of the first cam member 29, the rod portion 45 of the second member 24 and the first abutting face 40A of the first member 23 contact (abut on) each other. As the rod portion 45 of the second member 24 supported by the opening 25 and the first abutting face 40A of the first member 23 contact each other, superfluous movement of the first member 23 in the +Y direction is suppressed even if the force which moves the first member 23 in the +Y direction with respect to the carriage 7 acts on the first member 23 by the coil spring 49 in the initial state.

The control device 14 starts the gap adjusting operation using the gap adjusting device 17 according to, for example, the thickness of the recording paper P for forming an image. The control device 14 moves the carriage 7 supporting the first member 23 in the +Y direction by using the first drive mechanism 8, and makes the end 50 of the first member 23 and the abutting member 51 the position of which is fixed abut on each other. Thereby, the force in the −Y direction acts on the first member 23. The first member 23 starts movement in the −Y direction relative to the carriage 7.

When the movement of the first member 23 in the −Y direction relative to the carriage 7 is started by the abutment on the abutting member 51, the projection 37 of the first member 23 and the protruding portion 29T of the first cam member 29 of the carriage 7 abuts on each other. As described above, the arm portion 36 is elastically deformable in the Z-axis direction. When the first member 23 moves in the −Y direction relative to the carriage 7 in a state where the protruding portion 29T of the first cam member 29 of the carriage 7 and the projection 37 of the first member 23 has abutted on each other, the arm portion 36 elastically deforms in the +Z direction. The projection 37 is able to move in the +Z direction by the elastic deformation of the arm portion 36 in the +Z direction while being guided by the first face 29A of the first cam member 29.

The control device 14 further moves the carriage 7 in the +Y direction toward the abutting member 51 by using the first drive mechanism 8 in a state where the end 50 of the first member 23 and the abutting member 51 the position of which is fixed are made to abut on each other. Thereby, the first member 23 further moves in the −Y direction relative to the carriage 7. Thereby, the projection 37 of the first member 23 which moves in the +Z direction while being guided by the first face 29A enters the first recess 32 by the elastic deformation of the arm portion 36 in the −Z direction after it has moved along the third face 29C. This results in a state shown in FIG. 11. In the following description, the state of the first member 23, as shown in FIG. 11, where the projection 37 is arranged in the first recess 32 is appropriately referred to as a second state.

At least a portion of the first recess 32 is smaller than the projection 37. Accordingly, the projection 37 is arranged in the first recess 32. In other words, the projection 37 contacts the second face 29B or the like of the first cam member 29, and is able to be caught in the first cam member 29. As the projection 37 is arranged in the first recess 32, movement of the first member 23 along the Y axis is regulated. In this embodiment, even in a case where the force in the −Y direction is exerted on the first member 23 by the coil spring 49, the projection 37 is arranged in the first recess 32, whereby movement of the first member 23 along the Y axis is regulated.

Figure 11:
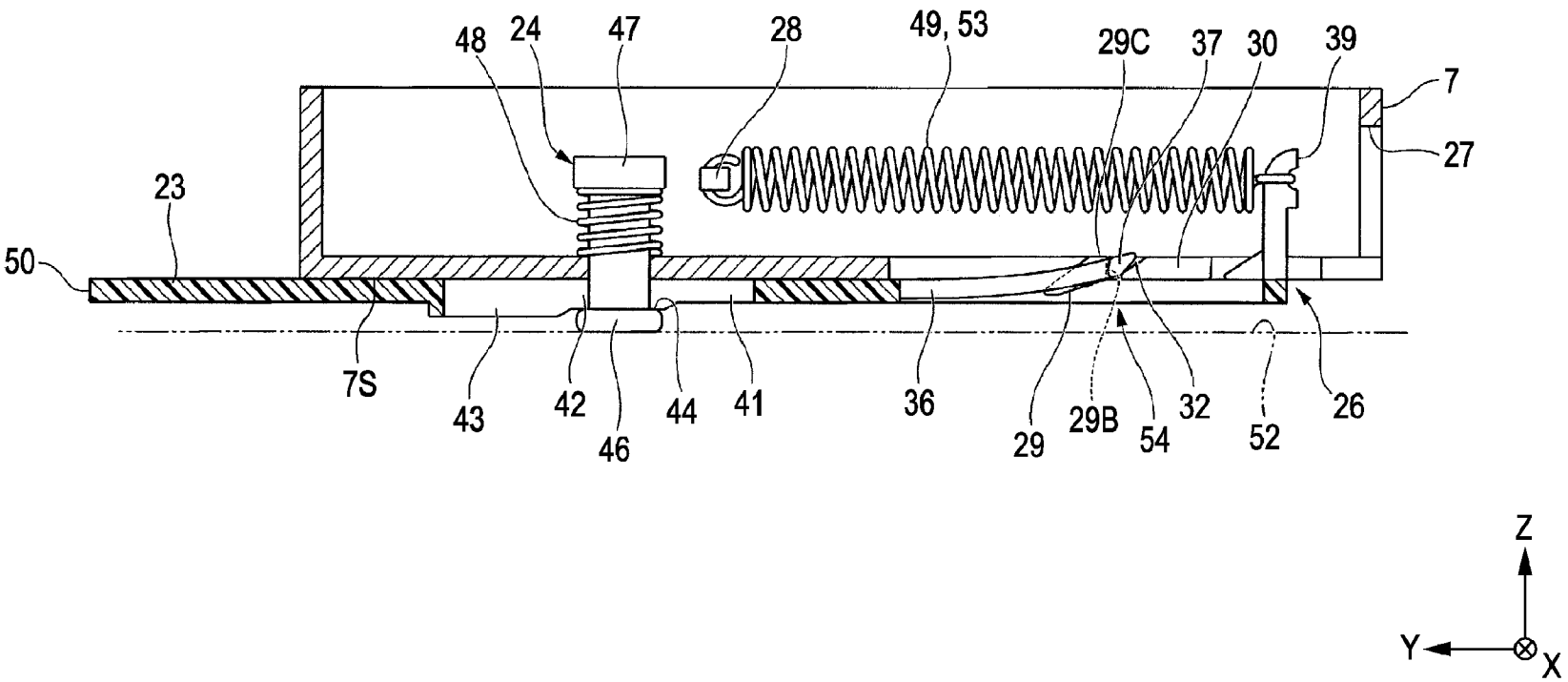
FIG. 11 is a view showing an example of the operation of the gap adjusting device according to the first embodiment.

In this embodiment, as shown in FIG. 11, in the second state where the projection 37 is arranged in the first recess 32, the second portion 42 of the second member 23 is arranged between the carriage 7 and the lower flange portion 46. Since the position of the lower flange portion 46 along the Z axis is substantially fixed by the supporting member 52 and the second portion 42 which is thicker than the first portion 41 is arranged between the carriage 7 and the lower flange portion 46, the carriage 7 moves in the +Z direction compared with the initial state. In the second state, the carriage 7 is arranged in a given position in the Z-axis direction according to the second thickness H2 of the second portion 42.

In this embodiment, the control device 14 moves the carriage 7 in the +Y direction by a predetermined distance by using the first drive mechanism 8 until the projection 37 of the first member 23 is arranged in the first recess 32 (until the first member 23 is brought into the second state) from a state where the end 50 of the first member 23 in the initial state is made to abut on the abutting member 51. The first member 23 moves in the −Y direction relative to the carriage 7 by a distance according to the movement distance of the carriage 7 in the +Y direction by the first drive mechanism 8. In the following description, the relative movement distance of the first member 23 from the initial state to the second state is appropriately referred to as a first movement distance. The first movement distance includes the movement distance when the carriage 7 is moved in the +Y direction toward the abutting member 51 in order to bring the first member 23 into the second state from the initial state in a state where the abutting member 51 and the end 50 of the first member 23 are made to abut on each other.

Additionally, the control device 14 is able to move the carriage 7 in the +Y direction, thereby making the end 50 of the first member 23 in the second state abut on the abutting member 51. When the movement of the first member 23 in the −Y direction relative to the carriage 7 is started by the abutment on the abutting member 51, the force which acts between the projection 37 of the first member 23 and the second cam member 30 of the carriage 7 increases. As described above, the arm portion 36 is elastically deformable in the Z-axis direction. When the first member 23 moves in the −Y direction relative to the carriage 7 in a state where the second cam member 30 of the carriage 7 and the projection 37 of the first member 23 has abutted on each other, the arm portion 36 elastically deforms in the +Z direction. The projection 37 is able to move in the +Z direction by the elastic deformation of the arm portion 36 in the +Z direction while being guided by the fifth face 30A of the second cam member 30.

The control device 14 further moves the carriage 7 in the +Y direction toward the abutting member 51 by using the first drive mechanism 8 in a state where the end 50 of the first member 23 and the abutting member 51 the position of which is fixed are brought into contact with each other. Thereby, the first member 23 further moves in the −Y direction relative to the carriage 7. Thereby, the projection 37 of the first member 23 which moves in the +Z direction while being guided by the fifth face 30A enters the second recess 33 by the elastic deformation of the arm portion 36 in the −Z direction after it has come out of the first recess 32 and has moved along the seventh face 30C. This results in a state shown in FIG. 12. In the following description, the state of the first member 23, as shown in FIG. 12, where the projection 37 is arranged in the second recess 33 is appropriately referred to as a third state.

At least a portion of the second recess 33 is smaller than the projection 37. Accordingly, the projection 37 is arranged in the second recess 33. In other words, the projection 37 contacts the sixth face 30B or the like of the second cam member 30, and is able to be caught in the second cam member 30. As the projection 37 is arranged in the second recess 33, movement of the first member 23 along the Y axis is regulated. In this embodiment, even in a case where the force in the −Y direction is exerted on the first member 23 by the coil spring 49, the projection 37 is arranged in the second recess 33, whereby movement of the first member 23 along the Y axis is regulated.

Figure 12:
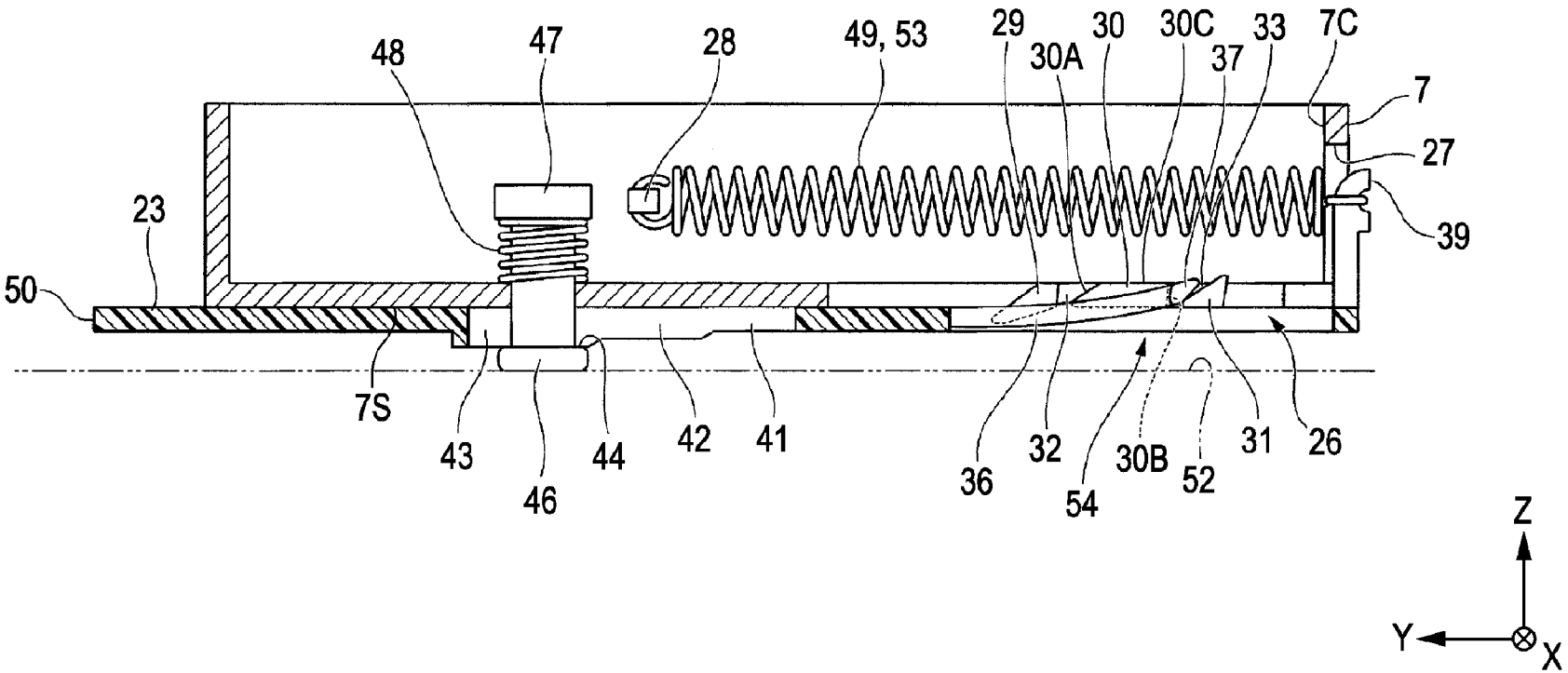
FIG. 12 is a view showing an example of the operation of the gap adjusting device according to the first embodiment.

In this embodiment, as shown in FIG. 12, in the third state where the projection 37 is arranged in the second recess 33, the third portion 43 of the first member 23 is arranged between the carriage 7 and the lower flange portion 46. Since the position of the lower flange portion 46 along the Z axis is substantially fixed by the supporting member 52 and the third portion 43 which is thicker than the second portion 42 is arranged between the carriage 7 and the lower flange portion 46, the carriage 7 moves in the +Z direction compared with the second state. In the third state, the carriage 7 is arranged in a given position in the Z-axis direction according to the third thickness H3 of the third portion 43.

In this embodiment, the control device 14 moves the carriage 7 in the +Y direction by a predetermined distance by using the first drive mechanism 8 until the projection 37 of the first member 23 is arranged in the second recess 33 (until the first member 23 is brought into the third state) from a state where the end 50 of the first member 23 in the second state is made to abut on the abutting member 51. The first member 23 moves in the −Y direction relative to the carriage 7 by a distance according to the movement distance of the carriage 7 in the +Y direction by the first drive mechanism 8. In the following description, the relative movement distance of the first member 23 from the second state to the third state is suitably referred to as a second movement distance. The second movement distance includes the movement distance when the carriage 7 is moved in the +Y direction toward the abutting member 51 in order to bring the first member 23 into the third state from the second state in a state where the abutting member 51 and the end 50 of the first member 23 are made to abut on each other.

Additionally, the control device 14 is able to move the carriage 7 in +Y direction, thereby making the end 50 of the first member 23 in the third state abut on the abutting member 51. When the movement of the first member 23 in the −Y direction relative to the carriage 7 is started by the abutment on the abutting member 51, the force which acts between the projection 37 of the first member 23 and the third cam member 31 of the carriage 7 increases. As described above, the arm portion 36 is elastically deformable in the Z-axis direction. When the first member 23 moves in the −Y direction relative to the carriage 7 in a state where the third cam member 31 of the carriage 7 and the projection 37 of the first member 23 has abutted on each other, the arm portion 36 elastically deforms in the +Z direction. The projection 37 is able to move in the +Z direction by the elastic deformation of the arm portion 36 in the +Z direction while being guided by the ninth face 31A of the third cam member 31.

Figure 13:
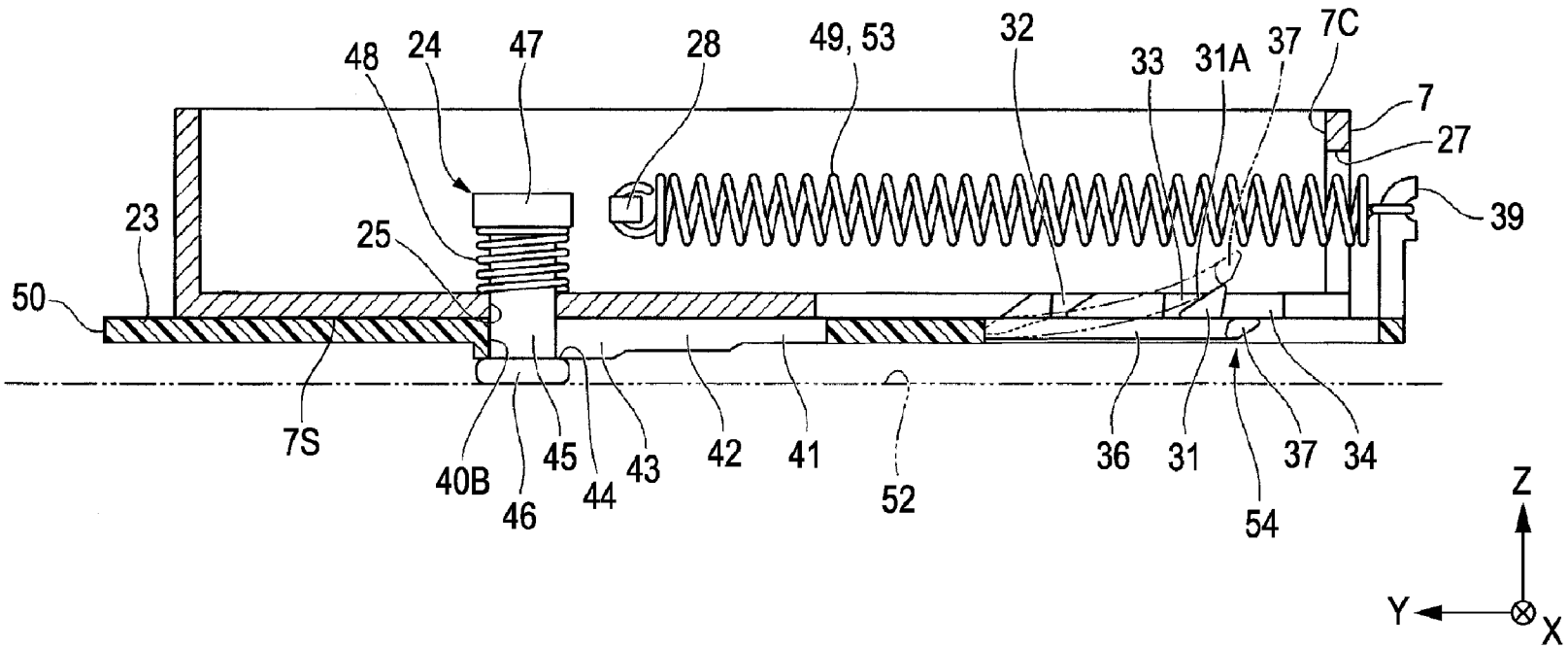
FIG. 13 is a view showing an example of the operation of the gap adjusting device according to the first embodiment.

The control device 14 further moves the carriage 7 in the +Y direction toward the abutting member 51 by using the first drive mechanism 8 in a state where the end 50 of the first member 23 and the abutting member 51 the position of which is fixed are brought into contact with each other. Thereby, the first member 23 further moves in the −Y direction relative to the carriage 7. Thereby, the projection 37 of the first member 23 which moves in the +Z direction while being guided by the ninth face 31A enters the second recess 34 by the elastic deformation of the arm portion 36 in the −Z direction after it has come out of the second passage 33. This results in a state shown in FIG. 13. In the following description, the state of the first member 23, as shown in FIG. 13, where the projection 37 is arranged in the second passage 34 is appropriately referred to as an open state.

The second passage 34 is larger than the projection 37. The second passage 34 has no portion in which the projection 37 is caught. Accordingly, the projection 37 is arranged on the side of the bottom face 7S through the second passage 34. As the projection 37 is arranged on the side of the bottom face 7S, the first member 23 is able to move in the +Y direction relative to the carriage 7 and return to the initial state by the force (biasing force) which acts on the first member 23 in the −Y direction by the coil spring 49.

In addition, when the first member 23 returns to the initial state from the open state, practically, the control device 14 moves the carriage 7 in the −Y direction using the first drive mechanism 8 so as to be separated from the abutting member 51 in a state where the projection 37 is arranged on the side of the bottom face 7S.

As the first member 23 returns to the initial state, the first portion 41 of the first member 23 is arranged between the carriage 7 and the lower flange portion 46. Since the position of the lower flange portion 46 along the Z axis is substantially fixed by the supporting member 52 and the first portion 41 which is thinner than the third portion 43 is arranged between the carriage 7 and the lower flange portion 46, the carriage 7 moves in the −Z direction compared with the third state. In the initial state, the carriage 7 is arranged in a given position in the Z-axis direction according to the first thickness H1 of the first portion 41.

The control device 14 moves the carriage 7 in the +Y direction by a predetermined distance by using the first drive mechanism 8 until the projection 37 of the first member 23 is arranged in the second passage 34 (until the first member 23 is brought into the open state) from a state where the end 50 of the first member 23 in the third state is made to abut on the abutting member 51. The first member 23 moves in the −Y direction relative to the carriage 7 by a distance according to the movement distance of the carriage 7 in the +Y direction by the first drive mechanism 8. In the following description, the relative movement distance of the first member 23 from the third state to the open state is appropriately referred to as a third movement distance. The third movement distance includes the movement distance when the carriage 7 is moved in the +Y direction toward the abutting member 51 in order to bring the first member 23 into the open state from the third state in a state where the abutting member 51 and the end 50 of the first member 23 are made to abut on each other.

In addition, as shown in FIG. 12, FIG. 13, etc., the side plate 7C arranged in front of the first member 23 in its movement direction is formed with the first passage 27 through which at least a portion of the first member 23 including the second hook portion 39. Thus, the movement of the first member 23 is not hindered.

As shown in FIG. 13, in the open state, the rod portion 45 of the second member 24 and the second abutting face 40B of the first member 23 contact each other. As the rod portion 45 of the second member 24 supported by the opening 25 and the second abutting face 40B of the first member 23 contact each other, superfluous movement of the first member 23 in the −Y direction is suppressed even if the force which moves the first member 23 in the −Y direction with respect to the carriage 7 acts on the first member 23 by the operation of the first drive mechanism 8 and the abutting member 51 in the open state.

As described above, in this embodiment, the movement distance of the carriage 7 to the +Z direction and the movement distance of the carriage 7 to the −Z direction is adjusted according to the movement distance (movement distance of the carriage 7 in the +Y direction toward the abutting member 51) of the first member 23 in the −Y direction relative to the carriage 7. Additionally, in this embodiment, the movement distance of the carriage 7 is adjusted according to the movement distance (movement distance of the carriage 7 in the +Y direction toward the abutting member 51) of the first member 23 in the −Y direction relative to the carriage 7. In this embodiment, the carriage 7 is able to move in the +Z direction by a distance according to the difference between the first thickness H1 of the first portion 41 and the second thickness H2 of the second portion 42 by relatively moving the first member 23 by the first movement distance in the −Y direction from the initial state. Additionally, the carriage 7 is able to move in the +Z direction by a distance according to the difference between the second thickness H2 of the second portion 42 and the third thickness H3 of the third portion 43 by relatively moving the first member 23 by the second movement distance in the −Y direction from the second state. Additionally, the carriage 7 is able to move in the −Z direction by a distance according to the difference between the third thickness H3 of the third portion 43 and the first thickness H1 of the first portion 41 by relatively moving the first member 23 by the third movement distance in the −Y direction from the third state.

Additionally, in this embodiment, the case where the first member 23 in the initial state moves by the first movement distance, and is brought into the second state, the case where the first member 23 in the second state moves by the second movement distance, and is brought into the third state, and the case where the first member 23 in the third state moves by the third movement distance, and is brought into the open state (initial state) has been described. However, the first member 23 can be brought into the third state from the initial state by moving the carriage 7 in the +Y direction by a predetermined distance by the first drive mechanism 8 in a state where the end 50 of the first member 23 in the initial state and the abutting member 51 are made to abut on each other, thereby moving the first member 23 relative to the carriage 7, for example, by a movement distance equivalent to the sum of the first movement distance and the second movement distance. Thereby, the carriage 7 is able to move in the +Z direction by a distance according to the difference between the first thickness H1 of the first portion 41 and the third thickness H3 of the third portion 43.

Additionally, in this embodiment, the movable range of the first member 23 along the Y axis with respect to the carriage 7 is specified by the opening 40 including the first abutting face 40A and the second abutting face 40B. That is, in this embodiment, the opening 40 functions as a specifying portion which specifies the movable range of the first member 23 along the Y axis. By the movement the first member 23 in the −Y direction relative to the carriage 7, the first member 23 in a state (state where the rod portion 45 and the second abutting face 40B has abutted on each other) where it is arranged at one end of the movable range of the first member 23 is able to return to a state (state where the rod portion 45 and the first abutting face 40A abuts on each other) where it is arranged at the other end of the movable range by a reset mechanism 53 including the coil spring 40.

Additionally, even when a biasing force acts on the first member 23 by the coil spring 49 of the reset mechanism 53, movement of the first member 23 with respective to the carriage 7 can be regulated in a given position along the Y axis by a stopper mechanism 54 including a plurality of first and second recesses 32 and 33 arranged in the carriage 7 along the Y-axis, and the projection 37 which is provided in the first member 23, and is able to be arranged in each of the first and second recesses 32 and 33.

Additionally, in this embodiment, the first member 23 includes the arm portion 36 which supports the projection 37, and is elastically deformable. Accordingly, the projection 37 can be made to leave and enter the first and second recesses 32 and 33 by the elastic deformation of the arm portion 36 by the abutment between the first, second, and third cam members 29, 30, and 31 of the carriage 7 and the projection 37, accompanying the movement of the first member 23 in the −Y direction relative to the carriage 7.

In a case where an image is formed on the recording paper P supported by the platen 6 by using the recording section 5, and in a case where the thickness of the recording paper P is, for example, the first thickness, the control device 14 brings the first member 23 into the initial state in the end region NA, and arranges the recording section 5 in the recording region MA using the first drive mechanism 8 in a state where the recording section 5 is arranged in a given position in the Z-axis direction. Additionally, in a case where an image is formed on the recording paper P with the second thickness larger than the first thickness, the control device 14 brings the first member 23 into the second state in the end region NA, and arranges the recording section 5 in the recording region MA using the first drive mechanism 8 in a state which the recording section 5 is arranged in a given position in the Z-axis direction. Additionally, in a case where an image is formed on the recording paper P with the third thickness larger than the second thickness, the control device 14 brings the first member 23 into the third state in the end region NA, and arranges the recording section 5 in the recording region MA using the first drive mechanism 8 in a state which the recording section 5 is arranged in a given position in the Z-axis direction.

Figure 14:
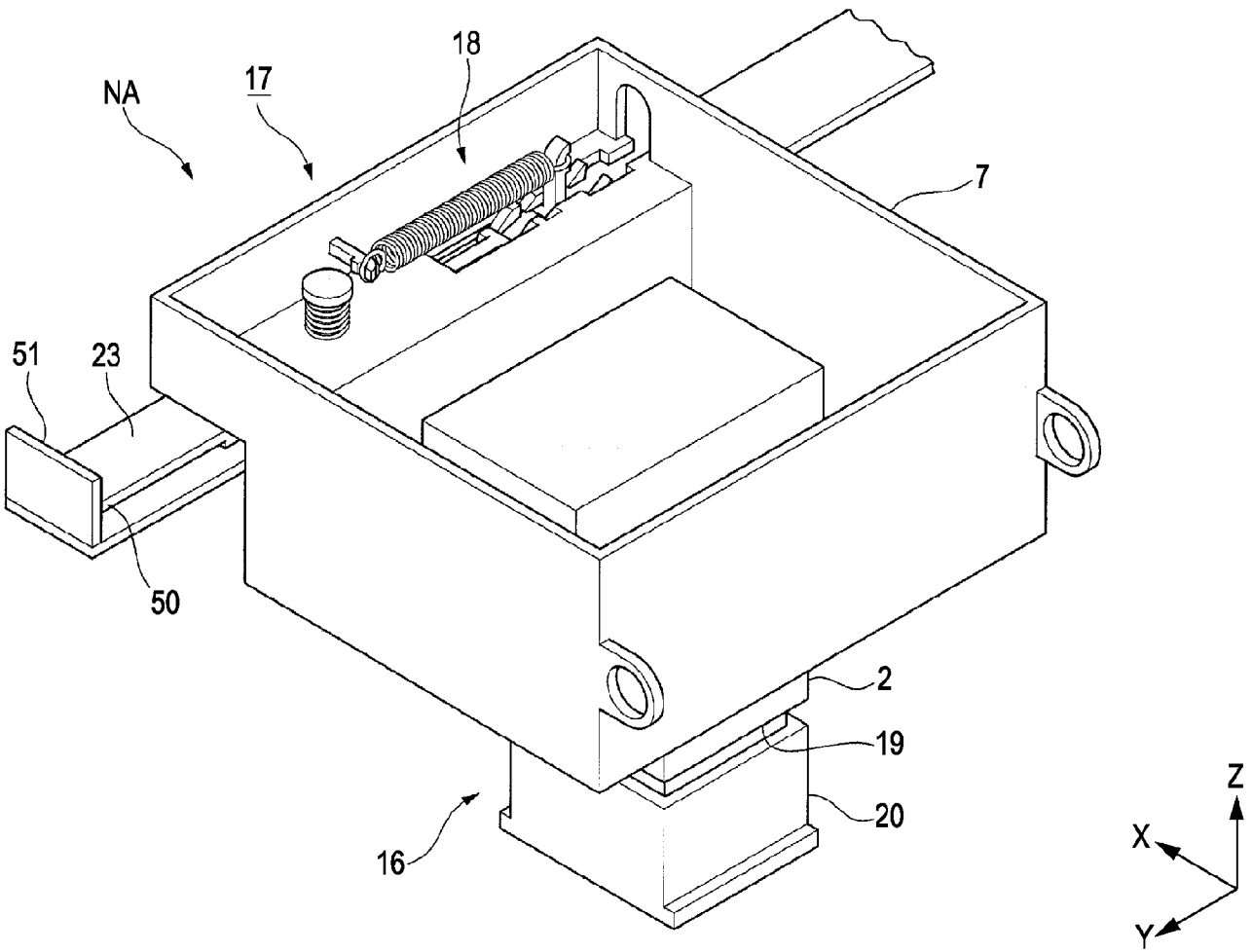
FIG. 14 is a view showing an example of the operation of a capping unit according to the first embodiment.

Additionally, in this embodiment, the capping unit 16 is arranged in the end region NA where the abutting member 51 is arranged. The capping unit 16 is able to cover the ejection face 19 of the recording head 2 in the end region NA where the abutting member 51 is arranged. Accordingly, as shown in FIG. 14, the ejection face 19 of the recording head 2 can be covered by the cap member 20, thereby performing maintenance of the recording head 2, in a state where the end 50 of the first member 23 and the abutting member 51 are made to abut on each other. In other words, gap adjusting operation using the abutting member 51, and maintenance operation using the cap member 20 can be executed in parallel.

As described above, according to this embodiment, the carriage 7 is movable in the +Z direction and the −Z direction (vertical direction) only by moving the first member 23 in the −Y direction relative to the carriage 7. Accordingly, gap adjustment of the recording head 2 supported by the carriage 7 and the recording paper P supported by the platen 6 can be executed efficiently.

Additionally, since gap adjusting operation is executed in the end region NA arranged outside one end of the recording region MA, enlargement of the ink jet printer 1 can be suppressed.

Second Embodiment

Next, a second embodiment will be described. In the following description, the same components as or equivalent to those of the above-described embodiment are denoted by the same reference numerals, and description thereof will be simplified or omitted.

Figure 15:
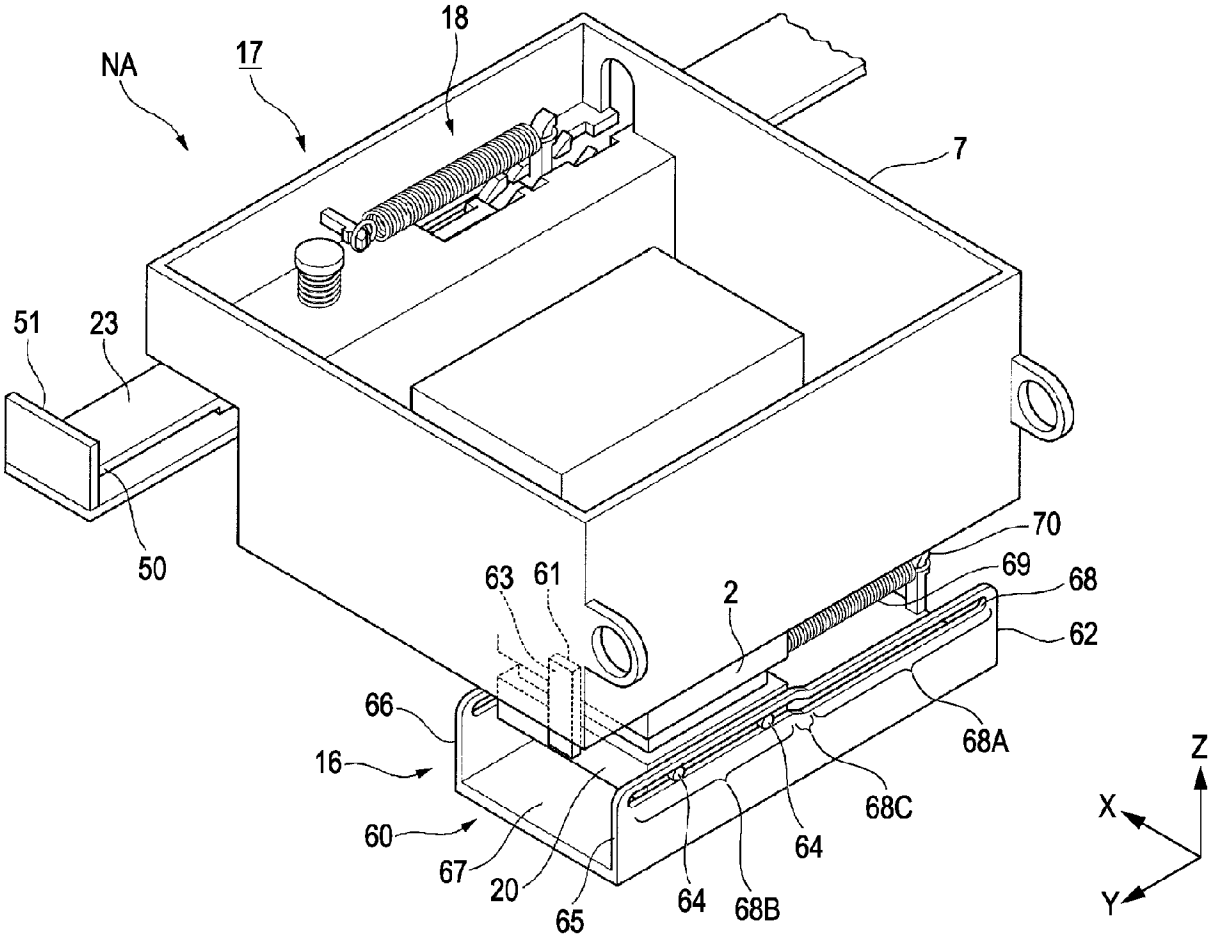
FIG. 15 is a perspective view showing a portion of an image forming apparatus according to a second embodiment.
Figure 16A:
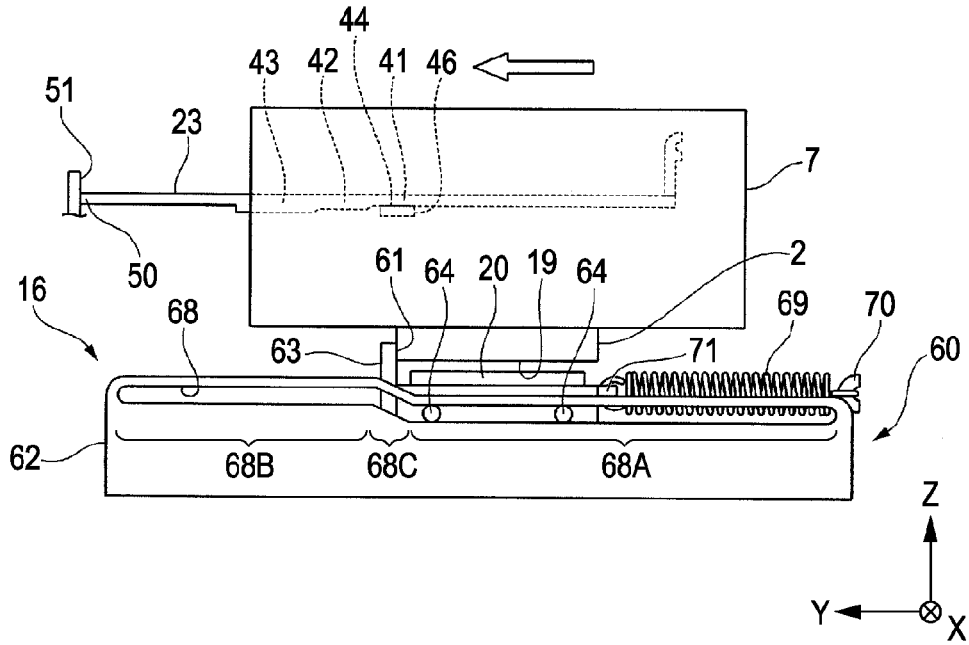
FIGS. 16A and 16B are views showing an example of the operation of the image forming apparatus according to the second embodiment.
Figure 16B:
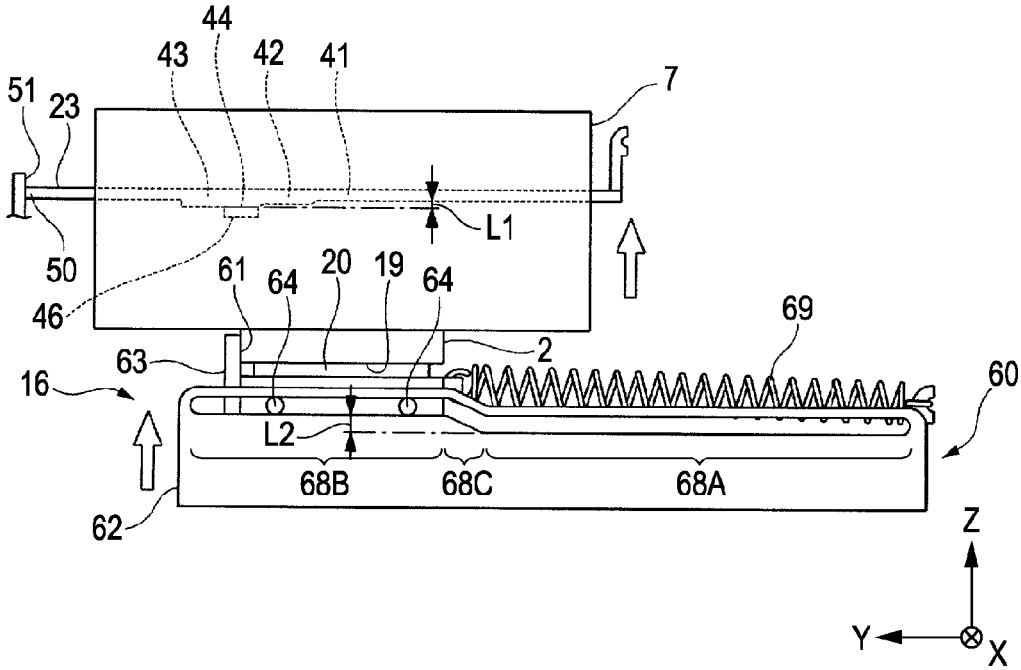

FIG. 15 is a perspective view showing a portion of the image forming apparatus 1 according to a second embodiment, and FIGS. 16A and 16B are schematic diagrams showing an example of the operation of the image forming apparatus according to the second embodiment. The characteristic portion of the second embodiment is that the capping unit 16 includes a second drive mechanism 60 which moves the cap member 20 so as to approach the recording head 2 with the movement (movement in the +Y direction) of the carriage 7 toward the abutting member 51.

In FIGS. 15 and 16, the second drive mechanism 60 includes a contact portion 61 which is connected to the cap member 20, contact a portion of the recording head 2 which moves in the +Y direction toward the abutting member 51, and is movable in synchronization with the movement of the recording head 2, and a guide member 62 which guides the cap member 20 so as to approach the recording head 2 in synchronization with the movement of the recording head 2.

The contact portion 61 is arranged in at least a portion of a plate member 63 which is connected to a side face of the cap member 20 on the +Y side. An upper end of the plate member 63 is arranged nearer to the +Z side than the top face of the cap member 20. In this embodiment, the contact portion 61 is a portion of the plate member 63 which is arranged nearer to the +Z side than the top face of the cap member 20.

A side face of the cap member 20 on the −X side is provided with a projection 64. A plurality of (two in this embodiment) the projections 64 is arranged in the Y-axis direction at the side face of the cap member 20 on the −X side. Similarly, a plurality of (two) the projections 64 is arranged in the Y-axis direction at the side face of the cap member 20 on the +X side.

The guide member 62 has a first plate 65, a second plate 66 which faces the first plate 65, and a third plate 67 which supports the first plate 65 and the second plate 66. The guide member 62 is able to arrange the cap member 20 between the first plate 65 and the second plate 66. The first plate 65 is arranged on the −X side with respect to the cap member 20. The second plate 66 is arranged on the +X side with respect to the cap member 20.

The first plate 65 includes a guide groove 68 where the projections 64 are arranged. The projections 64 are movable along the guide groove 68. The guide groove 68 is long in the Y-axis direction. The guide groove 68 includes a first portion 68A which is arranged in a first position in the Z-axis direction, and is nearly parallel to the Y axis, a second portion 68B which is arranged in a second position nearer to the +Z side than the first position, and is nearly parallel to the Y-axis, and a third portion 68C which connects the first portion 68A and the second portion 68B. Similarly, the guide groove 68 including the first portion 68A, the second portion 68B, and the third portion 68C is formed even in the second plate 66.

The second portion 68B is arranged on the +Y side of the first portion 68A. In this embodiment, the second portion 68B is nearer to the abutting member 51 than the first portion 68A.

As the projections 64 are arranged in the first portion 68A of the guide groove 68, the top face (cap face) of the cap member 20 is arranged in a third position corresponding to the first position in the Z-axis direction. As the projections 64 are arranged in the second portion 68B of the guide groove 68, the top face (cap face) of the cap member 20 is arranged in a fourth position corresponding to the second position in the Z-axis direction. The fourth position is a position nearer to the +Z side than the third position.

In the following description, the position of the cap member 20 when the projections 64 are arranged in the first portion 68A of the guide groove 68 is appropriately referred to as a standby position. Additionally, the position of the cap member 20 when the projections 64 are arranged in the second portion 68B of the guide groove 68 is appropriately referred to a capping-allowable position.

In this embodiment, the second drive mechanism 60 includes a third biasing member 69 which connects the cap member 20 and the guide member 62. In this embodiment, the third biasing member 69 is a coil spring which connects the third hook portion 70 provided in the guide member 62, and the fourth hook portion 71 provided in the cap member 20. The third hook portion 70 is arranged on the −Y-side end of the top face of the third plate 67. The fourth hook portion 71 is arranged at a −Y-side side face of the cap member 20 which faces the third hook portion 70.

Next, an example of the operation of the ink jet printer 1 including the gap adjusting device 17 and the capping unit 16, having the above-described configuration, will be described.

FIG. 16A shows a state where the end 50 of the first member 23 in the initial state abuts on the abutting member 51. When the first member 23 is in the initial state, the first portion 41 of the first member 23 is arranged between the bottom face 7S of the carriage 7, and the reference surface 44 of the lower flange portion 46. Additionally, while the end 50 of the first member 23 in the initial state and the abutting member 51 abut on each other, the recording head 2, and the contact portion 61 of the cap member 20 which exists in the standby position contact each other.

The control device 14 moves the carriage 7 supporting the first member 23 in the +Y direction toward the abutting member 51 by using the first drive mechanism 8, from the state shown in FIG. 16A. When the carriage 7 has been moved in the +Y direction in a state where the abutting member 51 the position of which is fixed and the first member 23 are made to abut on each other, the first member 23 does not move with respect to the abutting member 51, but the carriage 7 and the second member 24 move in the +Y direction so as to approach the abutting member 51. Thereby, the first member 23 moves in the −Y direction relative to the carriage 7 and the second member 24 by the abutment on the abutting member 51.

In this embodiment, the control device 14 moves the carriage 7 in the +Y direction toward the abutting member 51 so that the first member 23 changes from the initial state to the third state. Thereby, as shown in FIG. 16B, the third portion 43 of the first member 23 is arranged between the bottom face 7S of the carriage 7, and the reference surface 44 of the lower flange portion 46. The carriage 7 moves in the +Z direction by a distance L1 between the bottom face of the first portion 71 and the bottom face of the third portion in the Z-axis direction.

Additionally, with the movement of the carriage 7 in the +Y direction toward the abutting member 51, the cap member 20 which makes the contact portion 61 contact the recording head 2 moves in the +Y direction, and is arranged in the capping-allowable position. As describe above, the second drive mechanism 60 is able to move the cap member 20 in the +Z direction so as to approach the recording head 2 with the movement of the recording head 2 in the +Y direction by the first drive mechanism 8.

In this embodiment, the distance (distance between the first portion 68A and the second portion 68B in the Z-axis direction) L2 between the standby position and the capping-allowable position in the Z-axis direction is larger than the distance L1. That is, the movement distance (ascending distance) the cap member 20 in the +Z direction when the first member has changed from the standby position to the capping-allowable position is larger than the movement distance (ascending distance) of the carriage 7 (recording head 2) in the +Z direction when the first member 23 changes from the initial state to the third state. Thereby, as shown in FIG. 16B, the ejection face 19 of the recording head 2 and the top face of the cap member 20 can be brought into contact with each other.

Thus, according to this embodiment, capping operation on the recording head 2 by the cap member 20 can be executed in parallel with positioning operation (gap adjusting operation) of the recording head 2 in the Z-axis direction using the moving mechanism 18.

Additionally, the state of contact between the recording head 2 and the contact portion 61 is released by moving the recording section 5 in the Y direction after the gap adjusting operation or the capping operation is ended. Thereby, the force in the −Y direction is exerted on the cap member 20 by the coil spring 69. Accordingly, the cap member 20 is movable to the standby position while being guided by the guide member 62 (guide groove 68).

Third Embodiment

Next, a third embodiment will be described. In the following description, the same components as or equivalent to those of the above-described embodiment are denoted by the same reference numerals, and description thereof will be simplified or omitted.

Figure 17:
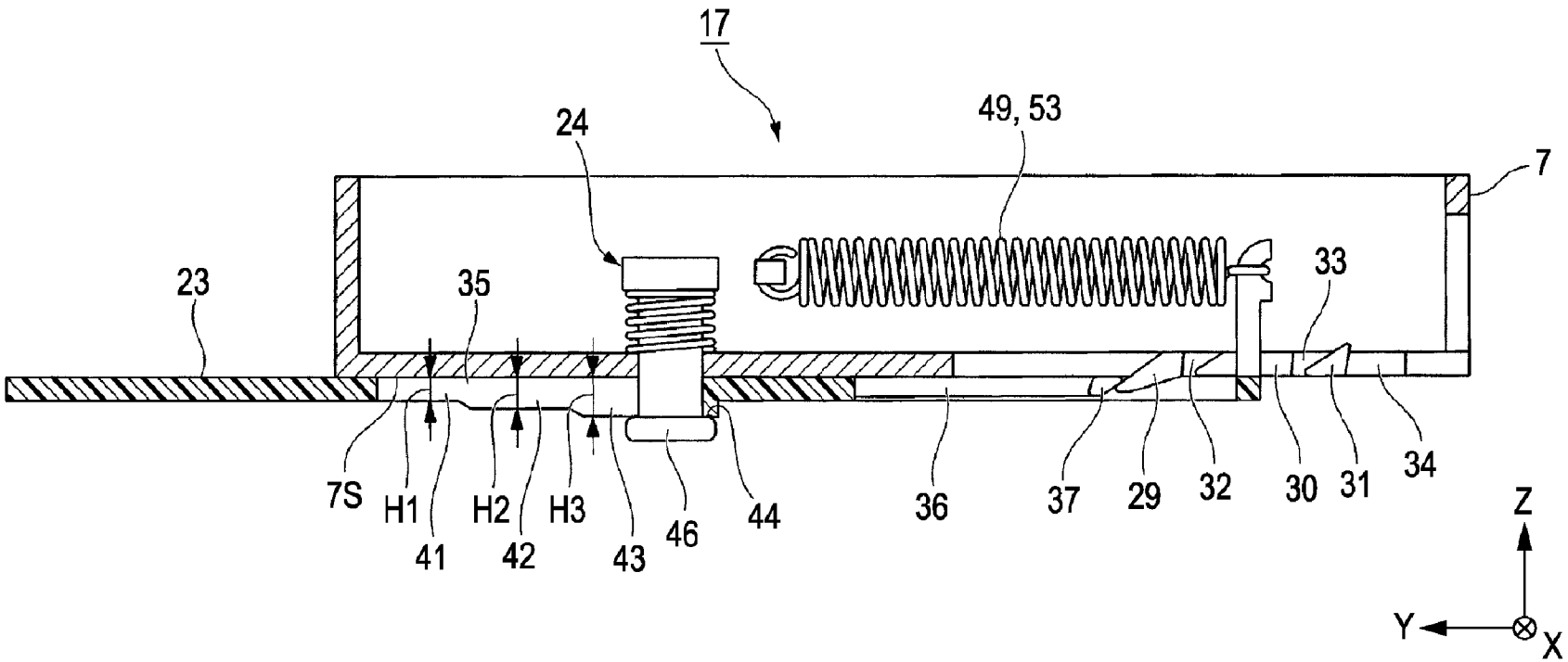
FIG. 17 is a perspective view showing a portion of an image forming apparatus according to a third embodiment.
Figure 18A:
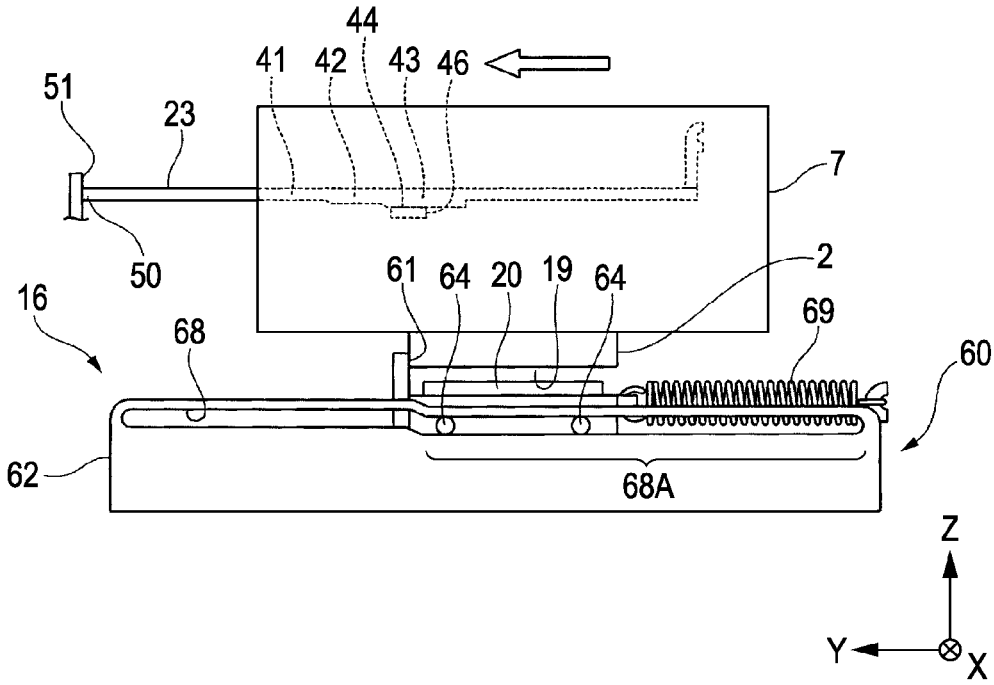
FIGS. 18A and 18*b* are views showing an example of the operation of the image forming apparatus according to the third embodiment.
Figure 18B:
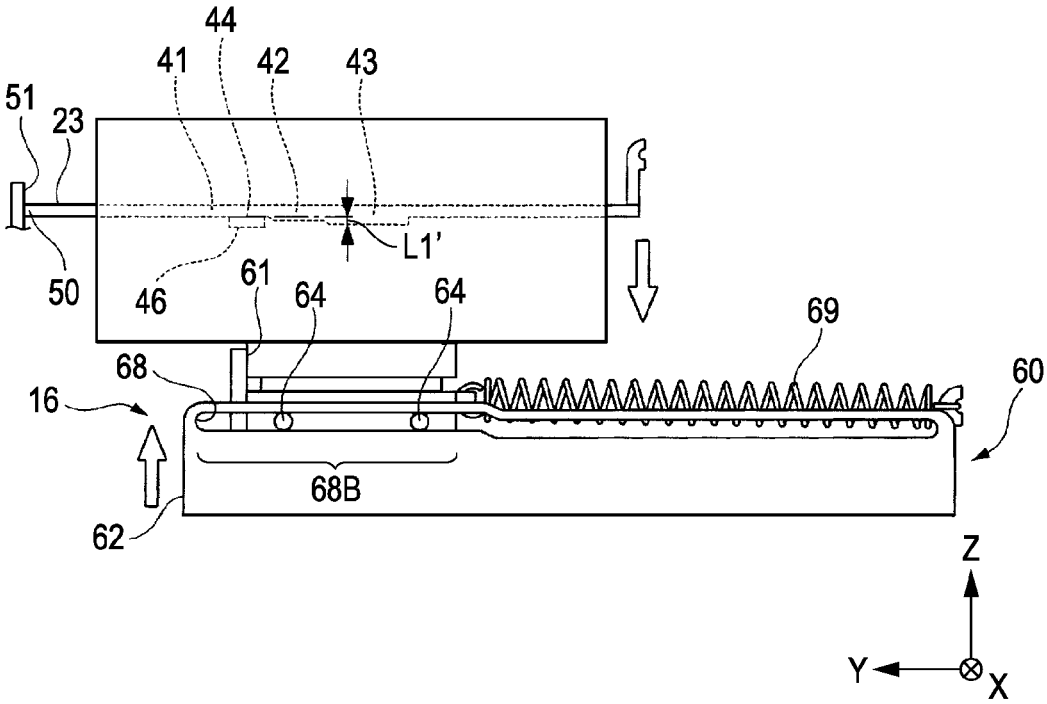

FIG. 17 is a perspective view showing a portion of the image forming apparatus 1 according to a third embodiment, and FIGS. 18A and 18B are schematic diagrams showing an example of the operation of the image forming apparatus according to the third embodiment. As shown in FIG. 17, the main body 35 of the first member 23 according to this embodiment a first portion 41 having a first thickness H1, a second portion 42 having a second thickness H2 larger than the first thickness H1, and a third portion 43 having a third thickness H3 larger than the second thickness H2. Among the first, second, and third portions 41, 42, and 43, the first portion 41 is arranged nearest to the +Y side, the second portion 42 is arranged on the +Y side next to the first portion 41, and the third portion 43 is arranged nearest to the −Y side.

That is, in this embodiment, in the initial state where the projection 37 is arranged on the +Y side of the first cam member 29, as shown in FIG. 17, the third portion 43 is arranged between the bottom face 7S of the carriage 7, and the reference surface 44 of the lower flange portion 46. Additionally, the second portion 42 is arranged between the bottom face 7S of the carriage 7, and the reference surface 44 of the lower flange portion 46 in a second state where the projection 37 is arranged in the first recess 32, and the first portion 41 is arranged between the bottom face 7S of the carriage 7 and the reference surface 44 of the lower flange portion 46 in a third state where the projection 37 is arranged in the second recess 33. That is, in this embodiment, the carriage 7 moves in the −Z direction with the movement of the first member 23 in the Y direction relative to the carriage 7.

Next, an example of the operation of the ink jet printer 1 including the gap adjusting device 17 and the capping unit 16, having the above-described configuration, will be described.

FIG. 18A shows a state where the end 50 of the first member 23 in the initial state abuts on the abutting member 51. When the first member 23 is in the initial state, the third portion 43 of the first member 23 is arranged between the bottom face 7S of the carriage 7, and the reference surface 44 of the lower flange portion 46. Additionally, while the end 50 of the first member 23 in the initial state and the abutting member 51 abut on each other, the recording head 2, and the contact portion 61 of the cap member 20 which exists in the standby position contact each other.

The control device 14 moves the carriage 7 supporting the first member 23 in the +Y direction toward the abutting member 51 by using the first drive mechanism 8, from the state shown in FIG. 18A. Thereby, the first member 23 moves in the −Y direction relative to the carriage 7. Similarly to the above-described embodiments, when the carriage 7 has been moved in the +Y direction toward the abutting member 51 in a state where the abutting member 51 the position of which is fixed and the first member 23 are made to abut on each other, the first member 23 does not move with respect to the abutting member 51, but the carriage 7 and the second member 24 move in the +Y direction so as to approach the abutting member 51. The first member 23 moves in the −Y direction relative to the carriage 7 and the second member 24 by the abutment on the abutting member 51.

In this embodiment, the control device 14 moves the carriage 7 in the +Y direction toward the abutting member 51 so that the first member 23 changes from the initial state to the third state. Thereby, as shown in FIG. 18B, the first portion 41 of the first member 23 is arranged between the bottom face 7S of the carriage 7, and the reference surface 44 of the lower flange portion 46. The carriage 7 moves in the −Z direction by a distance L1' between the bottom face of the first portion 71 and the bottom face of the third portion in the Z-axis direction.

As described above, in this embodiment, the moving mechanism 18 is able to move the recording head 2 supported by the carriage 7 in the −Z direction so as to approach the cap member 20 with the movement of the carriage 7 in the +Y direction toward the abutting member 51 in a state where the first member 23 and the abutting member 51 have contacted each other.

Additionally, with the movement of the carriage 7 in the +Y direction toward the abutting member 51, the cap member 20 which makes the contact portion 61 contact the recording head 2 moves in the +Y direction, and is arranged in the capping-allowable position. As describe above, the second drive mechanism 60 is able to move the cap member 20 in the +Z direction so as to approach the recording head 2 with the movement of the recording head 2 in the +Y direction by the first drive mechanism 8.

Thus, even in this embodiment, capping operation on the recording head 2 by the cap member 20 can be executed in parallel with positioning operation (gap adjusting operation) of the recording head 2 in the Z-axis direction using the moving mechanism 18.

In addition, although the case where the state shown in FIG. 18B is the third state where the projection 37 is arranged in the second recess 33 has been described in the third embodiment, it may be the open state where the projection 37 is arranged on the side of the bottom face 7S via the second passage 34. Even if the first member 23 is in the open state, the position of the carriage 7 is maintained in the position shown in FIG. 18B by the first drive mechanism 8, and the end 50 of the first member 23 is maintained in the state where it has abutted on the abutting member 51.

As described above, when the first member is in the open state where the first member 23 is arranged at one end of the movable range of the first member 23 by the movement of the first member in the Y direction 23 relative to the carriage 7, the recording head 2 moves in the −Z direction so as to come closest to the cap member 20. Thereby, the ejection face 19 of the recording head 2 can be covered well by the cap member 20.

In addition, in the first member 23 (main body 35) of the above-described first to third embodiments, among the first, second, and third portions 41, 42, and 43, for example, the second portion 42 is arranged nearest to the −Y side, the first portion 41 is arranged on the −Y side next to the second portion 42, and the third portion 43 is arranged nearest to the +Y side. Even if this configuration is adopted, the carriage 7 is movable in the +Z direction and the −Z direction according to the movement of the first member 23 in the Y direction.

In addition, a case where the first member 23 (main body 35) has three portions 41 to 43 whose thicknesses are different has been described in the above-described respective embodiments. However, it is natural that the first member may have four or more portions whose thicknesses are different, or may have two portions whose thicknesses are different. The number of the recesses of the stopper mechanism which are arranged in the carriage 7 is also suitably changed according to the portions of the first member 23 (main body 35) whose thicknesses are different.

In addition, although the case where the position of the abutting member 51 is fixed has been described as an example in the above-described respective embodiments, the abutting member 51 may move along the Y axis. For example, as the abutting member 51 moves in the Y direction in a state where the end 50 of the abutting member 51 and the first member 23 has abutted on each other, the first member 23 can be moved in the −Y direction with respect to the carriage 7.

In addition, although the case where the gap adjusting device 17 is provided in the ink jet printer 1 which forms an image on the recording paper P has been described as an example, in the ejected ink in the above-described respective embodiments, the gap adjusting device 17 may be provided in image forming apparatuses, such as a copying machine and a facsimile, not limited to the ink jet printer.

What is claimed is:

1. An image forming apparatus comprising:

a moving mechanism having a first member supported by a recording section so as to be movable along a first axis, and capable of moving the recording section in one direction and its opposite direction along a second axis intersecting the first axis according to the movement of the first member in one direction along the first axis relative to the recording section, thereby adjusting a gap between the recording section and a target;

a first drive mechanism which moves the recording section supporting the first member along the first axis; and an abutting member which is arranged in a position capable of abutting on the first member by the movement of the recording section outside a recording region where recording operation of the recording section is executed, and moves the first member in one direction relative to the recording section by the abutment on the first member.

2. The image forming apparatus according to claim 1, wherein the position of the abutting member is fixed, the first drive mechanism moves the recording section supporting the first member in one direction toward the abutting member in a state where the abutting member and at least a portion of the first member are made to abut on each other, and the first member moves in one direction relative to the recording section by the driving of the first drive mechanism.

3. The image forming apparatus according to claim 1, wherein the movement distance of the recording section along the second axis is adjusted according to the relative movement distance.

4. The image forming apparatus according to claim 1, wherein the movement direction of the recording section along the second axis is adjusted according to the relative movement distance.

5. The image forming apparatus according to claim 1, wherein the first member changes in thickness along the first axis, and relatively moves between a predetermined face of the recording section, and a reference surface of a reference member.

6. The image forming apparatus according to claim 5, further comprising a second member which is supported by the recording section so as to be relatively movable along the second axis, and supports the first member between the second member and the recording section so as to be movable along the first axis, wherein the reference member includes the second member.

7. The image forming apparatus according to claim 5, further comprising a supporting member which supports the reference member so that the position of the reference member along the second axis is substantially fixed.

8. The image forming apparatus according to claim 5, further comprising a first biasing member which biases the recording section and the reference member so that the recording section and the reference member approach each other.

9. The image forming apparatus according to claim 1, further comprising a cap member which covers at least a portion of the recording section outside the recording region where the abutting member is arranged.

10. The image forming apparatus according to claim 9, further comprising a second drive mechanism which moves the cap member with the movement of the recording section toward the abutting member so as to approach the recording section.

11. The image forming apparatus according to claim 10, wherein the second drive mechanism includes a contact portion which is connected to the cap member, contacts at least a portion of the recording section which moves toward the abutting member, and is movable in synchronization with the movement of the recording section, and a guide member which guides the cap member so as to approach the recording section.

12. The image forming apparatus according to claim 9, wherein the moving mechanism moves the recording section so as to approach the cap member with the movement of the recording section toward the abutting member in a state where the first member and the abutting member contact each other.

13. The image forming apparatus according to claim 12, further comprising a specifying portion which specifies the movable range of the first member along the first axis with respect to the recording section, and the recording section comes closest to the cap member when the first member is arranged at one end of the movable range by the movement in one direction.

14. The image forming apparatus according to claim 13, further comprising a reset mechanism which returns the first member arranged at one end of the movable range to the other end thereof by the movement in one direction.

15. The image forming apparatus according to claim 1, further comprising a stopper mechanism which regulates the movement of the first member with respect to the recording section in a given position along the first axis.

16. The image forming apparatus according to claim 1, wherein the recording section includes at least one of an ejection head capable of ejecting a fluid, and a carriage which supports the ejection head.

* * * * *